US005514534A

United States Patent [19]

Nozawa et al.

[11] Patent Number: 5,514,534

[45] **Date of Patent: *May 7, 1996**

[54] SILVER HALIDE PHOTOGRAPHIC LIGHT-SENSITIVE MATERIAL

[75] Inventors: Yasushi Nozawa; Hiroyuki Mifune; Hirotomo Sasaki, all of Minami-Ashigara, Japan

[73] Assignee: Fuji Photo Film Co., Ltd., Kanagawa, Japan

[ * ] Notice: the term of this patent shall not extend beyond the expiration date of Pat. No. 5,459,027.

[21] Appl. No.: 135,758

[22] Filed: Oct. 14, 1993

Related U.S. Application Data

[63] Continuation of Ser. No. 904,642, Jun. 26, 1992, abandoned.

[30] Foreign Application Priority Data

Jun. 28, 1991 [JP] Japan ..... 3-183485

[51] Int. Cl.[6] ..... G03C 1/09

[52] U.S. Cl. ..... 430/603; 430/605

[58] Field of Search ..... 430/567, 603, 430/605

[56] References Cited

U.S. PATENT DOCUMENTS

| | | | |
|---|---|---|---|
| 1,574,944 | 3/1926 | Sheppard | 430/603 |
| 1,602,591 | 10/1926 | Sheppard | 430/603 |
| 1,623,499 | 4/1927 | Sheppard et al. . | |
| 4,863,846 | 9/1989 | Tanaka et al. | 430/603 |
| 4,923,794 | 5/1990 | Sasaki et al. | 430/603 |
| 5,215,880 | 6/1993 | Kojima et al. | 430/601 |
| 5,273,874 | 12/1993 | Kojima et al. | 430/600 |
| 5,459,027 | 10/1995 | Takada et al. | 430/603 |

FOREIGN PATENT DOCUMENTS

| | | |
|---|---|---|
| 800958 | 12/1968 | Canada . |
| 0458278 | 11/1991 | European Pat. Off. . |
| 61-67845 | 4/1986 | Japan . |
| 61-114236 | 5/1986 | Japan . |
| 61-277947 | 12/1986 | Japan . |
| 62-178235 | 8/1987 | Japan . |
| 63-65438 | 3/1988 | Japan . |
| 3215844 | 9/1991 | Japan . |
| 3236049 | 10/1991 | Japan . |
| 1295462 | 11/1972 | United Kingdom . |
| 1396696 | 6/1975 | United Kingdom . |

OTHER PUBLICATIONS

Abstract of JP–A–61–277947.

*Primary Examiner*—Janet C. Baxter
*Attorney, Agent, or Firm*—Birch, Stewart, Kolasch & Birch

[57] ABSTRACT

Disclosed is a silver halide photographic light-sensitive material which comprises a support and at least one silver halide emulsion layer formed on the support. The emulsion layer contains at least one silver halide emulsion which is a tellurium-sensitized monodispersed emulsion.

19 Claims, No Drawings

SILVER HALIDE PHOTOGRAPHIC LIGHT-SENSITIVE MATERIAL

This application is a continuation, of application Ser. No. 07/904,642 filed on Jun. 26, 1992, now abandoned.

BACKGROUND OF THE INVENTION

1. Field of the Invention

The present invention relates to a silver halide photographic light-sensitive material, and more particularly to a silver halide photographic light-sensitive material which not only has high gradation and high sensitivity, but also has low fog and excels in storage stability.

2. Description of the Related Art

In recent years, a demand for silver halide photographic light-sensitive materials has been increasily strict. In particular, it has been increasingly requested that the material have high sensitivity and provide higher-quality images. This demand compels the researchers concerned to work harder in their effort to provide better silver halide photographic light-sensitive materials.

Silver halide emulsions for use in silver halide photographic light-sensitive materials are subjected to various types of chemical sensitization. Typical examples of chemical sensitization are: chalcogen sensitization (e.g., sulfur sensitization, selenium sensitization, or tellurium sensitization), precious-metal sensitization (e.g., gold sensitization or platinum sensitization), reduction sensitization, and a combination of these sensitizations.

As a sensitization, tellurium sensitization and tellurium sensitizers are generally described in several references, such as U.S. Pat. Nos. 1,623,499, 3,320,069, 3,772,031, 3,531,289, and 3,655,394, British Patents 235,211, 1,121, 496, 1,295,462, and 1,396,696, and Canadian Patent 800, 958. However, specific tellurium sensitizers are described in detail in a few references only, such as British Patents 1,295,462 and 1,396,696, and Canadian Patent 800,958.

As is described in, for example, Canadian Patent 800,958, a tellurium sensitizer, when applied singly to a silver halide emulsion, the emulsion will be more sensitive, less fogged, and better in contrast than if it is sensitized by a sulfur sensitizer commonly used in the art. When a telluruim sensitizer and a precious-metal sensitizer, particularly gold sensitizer, are applied, thus achieving gold-tellurium sensitization on a silver halide emulsion, the emulsion will have higher sensitivity than if it is subjected to sulfur-gold sensitization, but will be more fogged and will have its gamma value reduced, inevitably causing low gradation. Hence, it has ben strongly demanded that measures be taken to solve the problems with the tellurium sensitizer.

Even if the emulsion has been tellurium-sensitized only, it does not serve to improve the storage stability (i.e., the stability in sensitivity in a high-temperature, high-humidity condition) of the light-sensitive material using the emulsion. In view of this, too, some improvement should be made in tellurium sensitization.

Because of the above-mentioned problems with the tellurium sensitization, silver halide emulsions are usually subjected to two or more chalcogen sensitizations, for example a combination of sulfur sensitization and selenium sensitization. In practice, tellurium sensitization has not be employed. As a matter of fact, only a few references disclose tellurium sensitization. Most of the patents specified above describe the sulfur sensitization and the selenium sensitization which were experimentally carried out.

On the other hand, recently it has been found advisable to use monodispersed silver halide emulsions. A number of inventions concerning the use of monodispersed silver halide emulsions have been disclosed to the public. For example, JP-A-59-180536, JP-A-59-185329, JP-A-59-185330, JP-A-59-181337, JP-A-59-187338, JP-A-61-67845, and JP-A62-196645 disclose selenium sensitization of a monodispersed silver halide emulsion. ("JP-A" means Published Unexamined Japanese Patent Application.) However, these references make no mention of a combination of selenium sensitization and tellurium sensitization, which may solve the problems with tellurium sensitization.

Of the references specified above, JP-A-61-67845 teaches that it is useful to chemically ripen monodispersed core/shell-type silver halide grains in the presence of at least one water-soluble salt selected from the group consisting of Rh, Pd, It, and Pt, a chalcogen sensitizer, and a gold sensitizer. Tellurium sensitization is one of various chalcogen sensitizations. However, JP-A-61-67845 clarifies that a sulfur sensitizer and a selenium sensitizer are preferred as chalcogen sensitizers, and describes only a combination of sulfur sensitization and selenium sensitization. Althrough this publication refers to tellurium sensitization, it discloses no technique, whatever, of tellurium-sensitizing a monodispersed silver halide emulsion. It is impossible to expect, from the technical disclosure of the publication, any specific advantages resulting from tellurium-sensitizing a monodispersed silver halide emulsion.

SUMMARY OF THE INVENTION

The object of this invention is to provide a light-sensitive material which not only has high gradation and high sensitivity, but also is low-fogged and excels in storage stability.

More specifically, the object of the invention is to provide means for solving the problems with tellurium sensitization, thereby making it possible to put tellurium sensitization to practical use.

Through their repeated studies and research, the inventors have found that the object can be attained by the following silver halide photographic light-sensitive material.

The silver halide photographic light-sensitive material according to the invention comprises a support and at least one silver halide emulsion layer formed on the support, said emulsion layer containing at least one silver halide emulsion which is a tellurium-sensitized monodispersed emulsion.

The monodispersed silver halide emulsion occupies preferably 30% or more by weight, more preferably 50% or more by weight, of all silver halide emulsions used in the emulsion layer.

DETAILED DESCRIPTION OF THE PREFERRED EMBODIMENTS

The present invention will be described in detail below.

The monodispersed silver halide emulsion for use in the invention has a variation coefficient of 30% or less, preferably 22% or less, more preferably 18% or less, in terms of the distribution of grain size.

The term "variation coefficient" is the ratio of the standard deviation of grain size distribution to the average size of the grains. The size distribution of silver halide grains can be measured by any method available, but is usually determined by observing a photo of silver halide grains, taken by means of an electron microscope.

The term "grain size" means the diameter of a spherical grain, or the diameter of a sphere having the same volume as a grain having any other shape.

The tellurium sensitization performed in the present invention will be described.

Tellurium sensitizers preferred for use in the present invention are, for example, the compounds which are described in Journal of Chemical Society Communication 635 (1980).

Specific examples of the tellurium sensitizers are: phosphinetellurides (e.g., tributyl phosphinetelluride, tricyclohexyl phosphinetelluride, triisopropyl phosphinetelluride, butyl-diisopropyl phosphinetelluride, and dibutylphenyl phosphinetelluride), and other tellurium compounds (e.g., telluropentathionate sodium salt).

Of the tellurium compounds specified above, those represented by the following formula (I) or (II) are suitable for use in this invention:

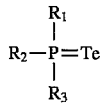

Formula (I)

where $R_1$, $R_2$ and $R_3$ are aliphatic groups, aromatic groups, heterocyclic groups, $OR_4$, $NR_5(R_6)$, $SR_7$, $OSiR_8(R_9)$ $(R_{10})$, X or hydrogen atoms, $R_4$ and $R_7$ are aliphatic groups, aromatic groups, heterocyclic group, hydrogen atoms or cations, $R_5$ and $R_6$ are aliphatic groups, aromatic groups, heterocyclic groups or hydrogen atoms, $R_8$, $R_9$ and $R_{10}$ are aliphatic groups, and X is a halogen atom.

The formula (I) will now be explained in detail.

The aliphatic groups represented by $R_1$, $R_2$, $R_3$, $R_4$, $R_5$, $R_6$, $R_7$, $R_8$, $R_9$, and $R_{10}$ in the formula (I) are preferably those having 1 to 30 carbon atoms. Particularly preferable are alkyl group, alkenyl group, alkynyl group, and aralkyl group, each having 1 to 20 carbon atoms and present in the form of a straight chain, a branch, or a ring. Examples of alkyl group, alkenyl group, alkynyl group and aralkyl group are: methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentynyl, benzyl, and phenetyl.

The aromatic groups represented by $R_1$, $R_2$, $R_3$, $R_4$, $R_5$, $R_6$ and $R_7$ in the formula (I) are preferably those having 6 to 30 carbon atoms. Particularly preferred is aryl group having 6 to 20 carbon atoms and present in the form of a single ring or a condense ring, such as phenyl group or naphthyl group.

The heterocyclic groups identified by $R_1$, $R_2$, $R_3$, $R_4$, $R_5$, $R_6$ and $R_7$ in the formula (I) are saturated or unsaturated 3- to 10-membered heterocyclic groups, each having at least one atom selected from the group consisting of a nitrogen atom, an oxygen atom and a sulfur atom. They can form a single ring, or can combine with an aromatic group or another heterocyclic group, thus forming a condense ring. Preferable are 5- or 6-membered aromatic heterocyclic group such as pyridyl, furyl, thienyl, thiazolyl, imidazolyl, and benzimidazolyl.

The cations represented by $R_4$ and $R_7$ in the formula (I) are of alkali metal or ammonium.

The halogen atom identified by X in the formula (I) is, for example, a fluorine atom, a chlorine atom, a bromine atom, or a iodine atom.

The aliphatic groups, the aromatic groups, and the heterocyclic groups—all specified above—can be substituted.

Typical examples of the substituent groups are: alkyl group, aralkyl group, alkynyl group, aryl group, alkoxy group, aryloxy group, amino group, acylamino group, ureido group, urethane group, sulfonylamino group, sulfamoyl group, carbamoyl group, sulfonyl group, sulfinyl group, alkyloxycarbonyl group, aryloxycarbonyl group, acyl group, acyloxy group, phosphoric acid group, diacylamino group, imido group, alkylthio group, arylthio group, a halogen atom, cyano group, sulfo group, carboxyl group, hydroxyl group, phosphono group, nitro group, and heterocyclic group. These groups can be substituted.

In the case where two or more substituted groups are used, they canny be either identical or different.

$R_1$, $R_2$, and $R_3$ can combine together and with phosphor atoms, forming a ring. Alternatively, $R_5$ and $R_6$ can combine, forming a nitrogen-containing heterocyclic ring.

In the formula (I), $R_1$, $R_2$, and $R_3$ are preferably aliphatic groups or aromatic groups. More preferably, they are alkyl groups or aromatic groups.

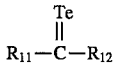

Formula (II)

where $R_{11}$ is aliphatic group, aromatic group, hetero cyclic group or $—NR_{13}(R_{14})$, $R_{12}$ is $—NR_{15}(R_{16})$, $—N(R_{17})N(R_{18})R_{19}$ or $—OR_{20}$, $R_{13}$, $R_{14}$, $R_{15}$, $R_{16}$, $R_{17}$, $R_{19}$ and $R_{10}$ are hydrogen atoms, aliphatic groups, aromatic groups, heterocyclic groups or acyl groups, $R_{11}$ and $R_{15}$, $R_{11}$ and $R_{17}$, $R_{11}$ and $R_{18}$, $R_{11}$ and $R_{20}$, $R_{13}$ and $R_{15}$, $R_{13}$ and $R_{17}$, $R_{13}$ and $R_{18}$, and $R_{13}$ and $R_{20}$ can combine, forming a ring.

The general formula (II) will now be explained in detail.

The aliphatic groups represented by $R_{11}$, $R_{12}$, $R_{13}$, $R_{14}$, $R_{15}$, $R_{16}$, $R_{17}$, $R_{18}$, $R_{19}$ and $R_{20}$ in the formula (II) are preferably those having 1 to 30 carbon atoms. Particularly preferable are alkyl group, alkenyl group, alkynyl group, and aralkyl group, each having 1 to 20 carbon atoms and present in the form of a straight chain, a branch, or a ring. Examples of alkyl group, alkenyl group, alkynyl group and aralkyl group are: methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentynyl, benzyl, and phenetyl.

The aromatic groups represented by $R_{11}$, $R_{12}$, $R_{13}$, $R_{14}$, $R_{15}$, $R_{16}$, $R_{17}$, $R_{18}$, $R_{19}$ and $R_{20}$ in the formula (II) are preferably those having 6 to 30 carbon atoms. Particularly preferred is aryl group having 6 to 20 carbon atoms and present in the form of a single ring or a condense ring, such as phenyl group or naphthyl group.

The heterocyclic groups identified by $R_{11}$, $R_{12}$, $R_{13}$, $R_{14}$, $R_{15}$, $R_{16}$, $R_{17}$, $R_{18}$, $R_{19}$ and $R_{20}$ in the formula (II) are saturated or unsaturated 3- to 10-membered heterocyclic groups, each having at least one atom selected from the group consisting of a nitrogen atom, an oxygen atom and a sulfur atom. They can be each a single ring, or can combine with an aromatic group or another heterocyclic group, thus forming a condense ring. Preferable are 5- or 6-membered aromatic heterocyclic group such as pyridyl, furyl, thienyl, thiazolyl, imidazolyl, and benzimidazolyl.

It is desirable that the acyl groups identified by $R_{13}$, $R_{14}$, $R_{15}$, $R_{16}$, $R_{17}$, $R_{18}$, $R_{19}$ and $R_{20}$ shown in the formula (II) have 1 to 30 carbon atoms. More preferably, they are acyl groups having 1 to 20 carbon atoms and present in the form of a straight chain or a branch. Examples of these acyl groups are acetyl, benzoyl, formyl, pivaloyl, and decanoyl.

In the case where $R_{11}$ and $R_{15}$, $R_{11}$ and $R_{17}$, $R_{11}$ and $R_{18}$, $R_{11}$ and $R_{20}$, $R_{13}$ and $R_{15}$, $R_{13}$ and $R_{17}$, $R_{13}$ and $R_{18}$, and $R_{13}$ and $R_{20}$ combine, forming a ring, the ring is, for example, alkylene group, arylene group, aralkylene group or alkenylene group.

The aliphatic groups, the aromatic groups, and the heterocyclic groups, described above, can be substituted by the substituent groups specified in the general formula (I).

In the formula (II), $R_{11}$ is preferably aliphatic group, aromatic group, or —$NR_{13}(R_{14})$, and $R_{12}$ is —$NR_{15}(R_{16})$. $R_{13}$, $R_{14}$, $R_{15}$ and $R_{16}$ are aliphatic groups or aromatic groups.

More preferably, in the formula (II), $R_{11}$ is aromatic group or —$NR_{13}(R_{14})$, $R_{12}$ is —$NR_{15}(R_{16})$, and $R_{13}$, $R_{14}$, $R_{15}$ and $R_{16}$ are alkyl groups or aromatic groups. Preferably, $R_{11}$ and $R_{15}$, and $R_{13}$ and $R_{15}$ are attached to each other through alkylene group, allylene group, aralkylene group, or alkenylene group.

Specific examples of the compounds represented by the formulas (I) and (II) are as follows. Nonetheless, the compounds used in the invention are not limited to these specified below.

$(nC_4H_9)_3P{=}Te$ Compound-1

$(tC_4H_9)_3P{=}Te$ Compound-2

Compound-3

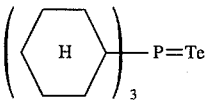

$((i)C_3H_7)_3P{=}Te$ Compound-4

Compound-5

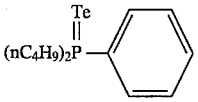

Compound-6

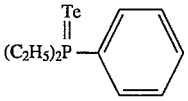

$((i)C_4H_9)_3P{=}Te$ Compound-7

$((i)C_4H_9)_2P(Te)C_4H_9(n))$ Compound-8

$(i)C_3H_7P(Te)(C_4H_9(n))_2$ Compound-9

$((i)C_3H_7)_2P(Te)C_4H_9(n)$ Compound-10

$(i)C_3H_7P(Te)(C_4H_9(i))_2$ Compound-11

$((i)C_3H_7)_2P(Te)C_4H_9(i)$ Compound-12

$((i)C_3H_7)P(Te)C_3H_{17}(n)$ Compound-13

$C_2H_5P(Te)(OC_2H_5)_2$ Compound-14

$(nC_4H_9O)_3P{=}Te$ Compound-15

$C_2H_5P(Te)(N(CH_3)_2)_2$ Compound-16

Compound-17

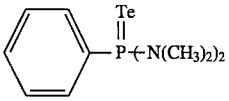

$(CH_3)_2N)_3P{=}Te$ Compound-18

-continued $((CH_3)_3SiO)_2P(Te)H$ Compound-19

Compound-20

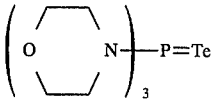

$(C_2H_5)_2PN(C_2H_5)_2$ Compound-21

$H_2PNH_2$ Compound-22

Compound-23

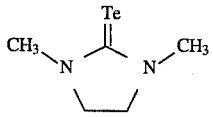

Compound-24

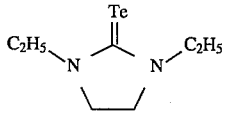

Compound-25

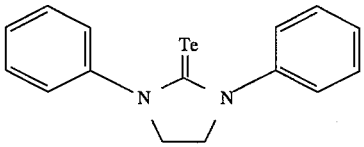

Compound-26

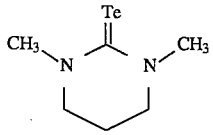

Compound-27

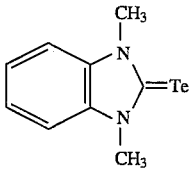

Compound-28

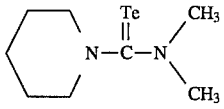

Compound-29

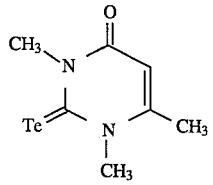

Compound-30

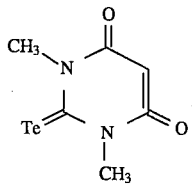

-continued

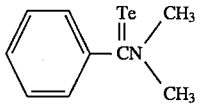

Compound-31

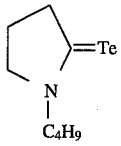

Compound-32

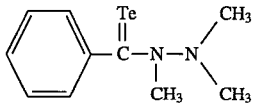

Compound-33

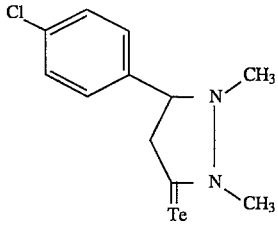

Compound-34

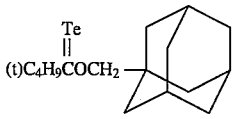

Compound-35

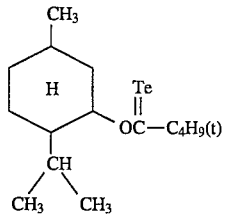

Compound-36

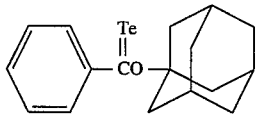

Compound-37

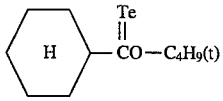

Compound-38

The compounds of the formulas (I) and (II), which are used in this invention, can be synthesized by the methods known in the art, as is disclosed in Journal of Chemical Society (A), 2927 (1969), Journal of Organometallic Chemistry, 4,320 (1965), ibid, 1,200 (1963), ibid, 113, C35 (1976), Phosphorus Sulfur 15, 155 (1983), Chemische Berichte, 109, 2996 (1976), Journal of Chemical Society Chemical Communication, 635 (1980), ibid, 1102 (1979), ibid, 645 (1979), ibid, 820 (1987), Journal of Chemical Society Perkin Transaction 1,2191 (1980), The Chemistry of Organo Selenium and Tellurium Compounds, Vol. 2, pp. 216–267 (1987).

The tellurium sensitizers used in the tellurium sensitization of the invention are compounds which form silver telluride in the surface or interior of a silver halide grain, which is considered to function as a sensitization nucleus.

The speed with which silver telluride is formed in the silver halide emulsion can be determined by the following test.

When a tellurium sensitizer is added in a great amount (e.g., $1\times10^{-3}$ mol/mol Ag), the silver telluride formed absorbs light beam of the visible region. Hence, the method disclosed in E. Moisar, "Journal of Photographic Science," Vol. 14, p. 181 (1966) and ibid., Vol. 16, p. 102 (1968) can be applied for sulfur sensitizers. Therefore, the relative speed at which silver telluride is formed can easily be obtained by the same method as used in determining the amount of silver sulfide formed in a silver halide emulsion from the infinite reflectivity of the emulsion to visible light beams (520 nm) in accordance the Kubelka-Munk formula. Since this reaction is apparently similar to a first-order reaction, a pseudo-first-order reaction rate constant can be obtained, too.

It will now be described how to obtain a pseudo-first-order reaction rate constant.

An emulsion which contains octahedral silver bromide grains having an average size of 0.5 μm (containing 0.75 mol of AgBr and 80 g of gelatin per kilogram) is maintained at 50° C., while holding pH and pAg at 6.3 and 8.3, respectively. A telluride dissolved in an organic solvent (e.g., methanol) is added to the emulsion, in an amount of $1\times10^{-3}$ mol/mol Ag. The resultant emulsion is filled in a cell having a thickness of 1 cm. Then, the reflectivity (R) of the emulsion to light beams of 520 nm is detected at times by means of a spectrophotometer having an integrating sphere, using the reflectivity of a blank emulsion as reference. Every reflectivity, thus detected, is substituted in the Kubelka-Munk formula, $(1-R)^2/2R$. The time span until the value of $(1-R)^2/2R$ becomes 0.01 is measured. The pseudo-first-order reaction rate constant k ($min^{-1}$) is determined from the time thus measured. If no silver telluride is formed at all, R=1, and the Kubelka-Munk value is 0 as in the case where no telluride is present. Preferable is a compound which is found to have a pseudo-first-order reaction rate constant K of $1\times10^{-8}$ to $1\times10^{0}$ $min^{-1}$ when tested in exactly the same way as described above.

The pseudo-first-order reaction rate constants of the tellurium sensitizers used in the present invention, which have been obtained by performing the test described above, are as follows:

| | |
|---|---|
| Compound 7 | $k \simeq 4\times10^{-3}$ $min^{-1}$ |
| Compound 10 | $k \simeq 2\times10^{-3}$ $min^{-1}$ |
| Compound 12 | $k \simeq 8\times10^{-4}$ $min^{-1}$ |
| Compound 18 | $k \simeq 2\times10^{-4}$ $min^{-1}$ |
| Compound 4 | $k \simeq 7\times10^{-5}$ $min^{-1}$ |

In the case where a tellurium sensitizer is added in so small an amount that the absorption of light beam of the visible region can hardly be detected, the silver telluride formed can be isolated from the unreacted tellurium sensitizer, to determine the quantity of the silver telluride. For instance, the emulsion is immersed in an aqueous solution of a halogen salt or a water-soluble mercapto compound, thereby isolating the silver telluride from the unreacted tellurium sensitizer, and then a small amount of tellurium is quantitatively anlayzed by means of atomic absorption spectrometry. The reaction speed greatly varies by seveal orders, in accordance with not only the type of the compound but also the silver halide composition of the emulsion tested, the test temperature, the values of a Ag and pH, and the like. The tellurium sensitizers preferred for use in the present invention are compounds which can form silver telluride when reacted with a silver halide emulsion which has crystal habit. Generally speaking, any compound is used in the invention, that reacts with a silver halide emulsion at a temperature of 40° to 95° C., at a pH of 3 to 10, and at a pAg of 6 to 11.

More preferable as a tellurium sensitizer is a compound which has a pseudo-first-order reaction rate constant k of $1\times10^{-7}$ to $1\times10^{-1}$ $min^{-1}$ if tested by the method specified above at a temperature of 40° to 95° C., at a pH of 3 to 10, or at a pAg of 6 to 11.

In the present invention, tellurium sensitizers are used in an amount of $10^{-8}$ to $10^{-2}$ mol per mol of silver halide, preferably $10^{-7}$ to $5\times10^{-3}$ mol per mol of silver halide, depending on the type of silver halide grains used and the conditions of chemical sensitization performed.

There is no limitation to the conditions in which to effect chemical sensitization in the present invention. However, it is desirable that the silver halide grains be chemically sensitized at a pAg of 6 to 11, preferably 7 to 10 and at a temperature of 40° to 95° C., preferably 50° to 85° C.

Precious-metal sensitizers using gold, platinum, palladium, iridium or the like, should preferably be used in the present invention, along with the tellurium sensitizers. Specific example of precious-metal sensitizers are: chloroauric acid, potassium chloroaurate, potassium auric thiocyanate, gold sulfide, gold selnide, and the like. These precious-metal sensitizers can be used in an amount of about $10^{-7}$ to about $10^{-2}$ mol per mol of silver halide.

In this invention, it is also preferable to use sulfur sensitizers, too. Specific examples of sulfur sensitizers are: thio sulfates (e.g., hypo), thioureas (e.g., diphenyl thiourea, triethyl thiourea, and allyl thiourea), and known unstable iodides (e.g., rhodanines). These sulfur sensitizers can be used in an amount of about $10^{-7}$ to about $10^{-2}$ mol per silver halide.

Also it is desirable that selenium sensitizers be used, too, in the present invention. The unstable selenium sensitizer disclosed in JP-B-44-15748 ("JP-B" means Published Examined Japanese Patent Application) is a preferable example.

Specific examples of selenium sensitizers are: colloidal selenium, selenoureas (e.g., N,N-dimethyl selenourea, selenourea, tetramethyl selenourea), selenoamides (e.g., selenoaceto amid, N',N'-dimethyl-selenobenzamide), selenoketones (e.g., slenoacetone, selenobenzenephenone), selenides (e.g., triphenyl phosphineselenide, diethylselenide), seleno phosphate (e.g., tri-p-triselenophosphate), selenocar boxylic acid, esters, and isoselenocyanates. These selenium sensitizers can bee used in an amount of about $10^{-8}$ to about $10^{-3}$ mol per mol of silver halide.

In the present invention, a reduction sensitizer can be used, too. Specific examples of the reduction sensitizer are: stannous chloride, aminoiminomethane sulfinic acid, hydrazine derivative, borane compound (e.g., dimethylamineborane), silane compound, and polyamine compound.

Preferably, tellurium sensitization is carried out in this invention, in the presence of a solvent for dissolving the silver halide.

Specific examples of this solvent are: thiocyanate (e.g., potassium thiocyanate ), thioether compound (e.g., the compounds disclosed in U.S. Pat. Nos. 3,021,215 and 3,271,157, JP-B58-30571, and JP-A-60-136736, particularly 3,6-dithia-1,8-octadiol), and tetra-substituted thiourea compound (e.g., the compounds disclosed in JP-B-59-11892 and U.S. Pat. No. 4,221,863, particularly tetramethyl thiourea). Other examples of the solvent are: the thione compounds disclosed in JP-B-60-11341, the mercapto compounds disclosed in JP-B-63029727, the mesoion compounds disclosed in JP-A-60-163042, the selenoether compounds disclosed in U.S. Pat. No. 4,782,013, the telluoether compounds dislosed in JP-A-2-118566, and sulfides. Of these examples, thiocyanate, thioether compendious, tetra-substituted thiourea compounds, and thione compounds are preferred. The solvent can be used in an amount of about $10^{-5}$ to about $10^{-2}$ mol per mol of silver halide.

The silver halide used in the monodispersed silver halide emulsion of the present invention, and silver halide grains used in the same emulsion layer or different emulsion layers of the light-sensitive material according to the present invention (hereinafter generally called "grains used in the invention") are made of silver bromide, silver chloride, silver iodide, silver chlorobromide, silver chloroiodide, silver iodobromide, or silver chloroiodide. The emulsion used in the invention can contain not only these silver halide grains, but also grains of any other silver salt, such as silver rhodanide, silver sulfide, silver selenide, silver carbonate, silver phosphate or silver salt of organic acid. Alternatively, a part of each silver halide grain can be made of any other silver salt. To prepare a silver halide photographic light-sensitive material which can be developed and desilvered (i.e., bleached, fixed and bleach-fixed) at high speeds, it is desirable that the silver halide grains have a high silver chloride content. To prepare a silver halide photographic light-sensitive material which can be developed slowly, it is preferable that the silver halide grains contain silver iodide. The optimum amount in which to use silver iodide depends on the type of the light-sensitive material. Preferably, the silver iodide content is 0.1 to 15 mol % for X-ray sensitive material, and 0.1 to 5 mol % for microfilm and graphic art film. For photographic light-sensitive materials the typical example of which is color negative film, the silver iodide content ranges from 1 to 30 mol %, preferably 2 to 20 mol %, more preferably 3 to 15 mol %. In order to lessen lattice strain in each silver halide grain, it is recommendable that silver chloride be contained in the grain.

It is desirable that the silver halide emulsion for use in this invention contain grains which are not homogeneous in halogen composition. Typical example of such grains are those of double structure, each consisting of a core and shell which have different halogen compositions, as is disclosed in, for example, JP-B-43-13162, JP-A-61-215540, JP-A-60-222845, JP-A-60-143331, and JP-A-61-75337. Other examples of such grains are: those of triple structure, each formed of a core, a first shell and a second shell which have different halogen compositions, as is disclosed in JP-A-60-222844; and those consisting four or more layers. Still another example is grains of double structure, each coated with a thin layer of silver halide which has a halogen composition different from those of the core and shell.

Apart from the grains of the three types described in the preceding paragraph, grains having so-called junction structure can be used in the present invention. Various examples of grains having the junction structure are disclosed in JP-A-59-133540, JP-A-58-108526, European Patent 199, 290A2, JP-B-58-24772, JP-A-59-16254, and some other references. A junction-structure grain consists of a host crystal and a junction crystal which are different in composition from the host crystal and attached to the edge or corner of the host crystal. The host crystal is one which is homogeneous or one which has a core-shell structure.

The host crystal and junction crystal forming a junction-structure grain can, of course, be made of different silver halides. Further, one of these crystals can be made of a silver chloride (non-halite structure), such as silver rhodanide and silver carbonate, provided that it can be attached to the crystal which is made of silver halide.

In the case of silver iodide grains having the core-shell structure, it is desirable that the core contain more silver iodide than the shell. In some cases, the core should better contain less silver iodide than the shell. As for silver iodide grains having the junction structure, it is desirable that the host crystal contains more silver iodide than the junction crystal in some cases, and less silver iodide than the junction crystal in other cases. In either a core-shell grain or a Junction-structure grain, the two components can have a distinct boundary and an indistinct boundary. Alternatively, the boundary between the two components can have a composition which gradually changes from one component to the other.

When the silver halide grains used are those formed of two or more silver halides which are present in the form of a mixed crystal or a core-shell structure, it is important to control the halogen distribution among the grains. A method of measuring the halogen distribution is disclosed in JP-A-60254032. The more uniform the halogen distribution among the grains, the better. An silver halide emulsion containing grains whose variation coefficient is 20% or less is particularly desirable. Another preferable emulsion is one in which the grain size is correlated to the halogen composition of the grain, more specifically the iodine content of each grain is proportional to its size. A silver halide emulsion can be used in which the iodide content of each grain is inversely proportional to the grain size, or in which the grain size and the content of any other halogen are correlated, in accordance with the use of the light-sensitive material. In view of this it would be recommendable that two or more emulsions having different composition be mixed and used.

It is also essential to control the halogen composition in the near-surface region of the grain. More specifically, the content of silver iodide or silver chloride in the near-surface region should be increased to change the dye-adsorbing efficiency or developing speed of the grain, in accordance of the use of the light-sensitive material. In order to change the halogen composition in the near-surface region, a layer can be formed, either covering the entire grain or covering only part of the grain. In the case of a tetradecahedral grain having a (100) face and a (111) face, the halogen composition is changed in one surface only. In the case of a tabular grain, the halogen composition is changed in either one major surface of one side.

Silver halide grains suitable for use in this invention are regular grains which have no twinned crystal surfaces. Alternatively, they are single-twinned crystals each having one twinned surface, parallel multi-twinned crystals each having two or more parallel twinned surfaces, or non-parallel multi-twinned crystals each having two or more non-parallel twinned surfaces—all described in Nihon Shashin Gakkai, ed., "Fundamentals of Photographic Industry—Silver-Salt Photography," Corona, Inc., p. 163. Grains of any one of these types can be used to achieve the prescribed object. The technique of mixing grains having different shapes is disclosed in U.S. Pat. No. 4,865,964. This technique can be employed, if necessary. Regular crystals which can be used in the invention are: cubic crystals having (100) faces; octahedral crystals having (111) faces; and dodecahedral grains having (110) faces, disclosed in JP-B-55-42737 and JP-A-60-222842. Also, the grains having (h11) faces such as (211) faces, the grains having (hh1) faces such as (331) faces, the grains having (hk0) faces such as (210) faces, and the grains having (hk1) faces such as (321) faces—all described in Journal of Imaging Science, Vol. 30, p. 247 (1986)—can be used for specific purposes, though some care must taken to prepare these grains. Also, tetradeca hedral grains each having both a (100) face and a (111) face, grains each having both a (100) face and a (110) face, grains each having both a (111) face and a (110) face, or any other type of grains each having two or more different faces can be used in accordance with the application.

The ratio of the thickness of a tabular grain to the equivalent-sphere diameter of the grain is known as "aspect ratio" in the art, and defines the shapes of tabular grains. Tabular grains having an aspect ratio of 1 or more can be used in the present invention.

Tabular grains can be prepared by the methods disclosed in Cleve, "Photography Theory and Practice" (1930), p. 131, Gutoff, "Photographic Science and Engineering," Vol. 14, pp. 248–257 (1970), U.S. Pat. Nos. 4,434,226, 4,414,310, 4,433,048 and 4,439,520, and British Patent 2,112,157. As is described in U.S. Pat. No. 4,434,226, the use of tabular grains improves the coating adhesion of the emulsion and enhance the efficiency of color sensitization achieved by a sensitizing dye. It is desirable that the grains which occupy 80% or more of the total projected area of all grains have an average aspect ratio of 1 or more but less than 100, preferably 2 or more but less than 20, more preferably 3 or more but less than 10. Triangular, hexagonal, or circular tabular grains can be used. Preferable tabular grains are hexagonal grains having six sides having substantially the same length, as is disclosed in U.S. Pat. No. 4,797,354.

The silver halide emulsion of the invention, which contains tabular grains, can be prepared by any method, provided that it is a monodispersed one. The emulsion can be obtained by, for example, the method described in U.S. Pat. No. 4,775,617.

In most cases, the size of grains is represented in terms of equivalent-circle diameter, i.e., the diameter of a circle having the same area as the projected image of the grain. Grains having an average diameter of 0.6 microns or less, such as those disclosed in U.S. Pat. No. 4,748,106, are desirable to provide silver halide emulsion which serves to form high-quality images. Tabular grains which have a thickness of 0.5 microns or less, preferably 0.3 microns or less, is desirable since they serve to improve the sharpness of the light-sensitive material. Also desirable is an emulsion containing tabular grains which have a thickness-variation coefficient is only 30% or less. The emulsion disclosed in JP-A-63-163451 is also preferred which contains grains whose twinned surfaces are spaced part by a specific distance.

Dislocation lines, if any, in tabular grains can be observed by a transmission electron microscope. Grains having no dislocation lines at all, tabular grains having a few dislocation lines each, or tabular grains having many dislocation lines each, can be used in accordance with the specific object to achieve. Of these types of grains, those having many dislocation lines each are preferable. Various types of grains each having dislocation lines can be used. Examples of these are: grains each having straight dislocation lines; grains each having curving dislocation lines; and grains each having dislocation lines existing in a specific portion, e.g., the fringe. Dislocation lines should better be introduced into not only tabular grains, but also into regular grains or irregular grains (e.g., potato-shaped grains). In the case of regular grains or irregular grains, the dislocation lines are present preferably in specific portions such as apices and ridges of the grains.

The silver halide grains for use in this invention can be those which have been rounded by the process disclosed in European Patents 96,727B1 and 64,412B1, or those which have been surface-modified as is disclosed in JP-A-60-221320.

Grains having flat surfaces are generally used. Nonetheless, grains concave in their surfaces can be used for a specific purpose. Methods of making holes in a selected portion of a crystal (e.g., an apex or the center of the surface) are described in JP-A-58-106532 and JP-A-60-221320. An example of such grains are the ruffled grains disclosed in U.S. Pat. No. 4,643,966.

The grains the emulsion of the invention is to contain can be selected from grains of various sizes, from very fine grains having equivalent-sphere diameter of 0.05 microns or less to large grains having equivalent-sphere diameter of more than 10 microns. Grains having equivalent-sphere diameters of 0.1 to 3 microns are preferably used as light-sensitive silver halide grains.

To provide a light-sensitive material having a target gradiation, two or more types of monodispersed silver halide emulsions having different grain sizes can be coated in the form of a mixture on the same layer, or coated on different layers, thereby to form emulsion layers which are sensitive to substantially the same color. Alternatively, two or more types of polydispersed silver halide emulsions or a combination of monodispersed and polydispersed emulsions can be mixed or overlapped.

The photographic emulsion for use in the present invention can be prepared by methods described in, for example, P. Glafkides, "Chimie et Phisique Photographique," Paul Montel, 1967; G. F. Duffin, "Photographic Emulsion Chemistry," Focal Press, 1966; and V. L. Zelikman et al., "Making and Coating Photographic Emulsion," Focal Press, 1964. In other words, the emulsion can be prepared by acidification, neutralization, or ammonification. To react a soluble silver salt with soluble halogen salt, one-side mixing or simultaneous mixing, or both can be employed. Silver halide grains can be formed by means of so-called "reverse mixing," in which the grains are formed in the presence of an excessive amount of silver ions.

One of the simultaneous mixing methods is so-called "controlled double-jet method," in which pAg in the liquid in which to form silver halide grains is maintained at a prescribed value. This method is preferred for use in this invention since it serves to obtain silver halide grains which have a regular crystal shape and a virtually uniform size.

Methods of preparing emulsions, in which silver halide grains formed by deposition are added into a reaction vessel are preferred in some cases. Such methods are disclosed in, for example, U.S. Pat. Nos. 4,334,012, 4,301,241, and 4,150,994. By these methods, the grains can well be applied as seed crystals, or as grains to grow. If the grains are to be grown in the reaction vessel, they should be small. The grains can be introduced into the vessel, all at a time, in portions at several times, or little by little continuously. In some cases, it is recommendable that grains of different halogen compositions be added in order to modify the surface of the emulsion layer to form.

Methods of changing the halogen composition in part or whole of a silver halide grain are known, as is disclosed in U.S. Pat. Nos. 3,477,852 and 4,142,900, European Patents 273,429 and 273,430, and West German Laid-open Application 38 19 241. These are also useful methods of forming grains. Solution of soluble halogen or silver halide grains can be into a reaction vessel, thereby to form silver salt which can hardly be dissolved. The solution or the silver halide grains can be transformed into such gains, all at a time, in portions at several times, or little by little continuously.

Generally, grains are grown by feeding soluble silver salt and halogen salt into the reaction vessel, each in constant density and at constant speed. Other methods of growing grains, in which silver salt and halogen salt are fed in a varying density or at a changing speed, are also preferable. Such methods are described in British Patent 1,469,480, U.S. Pat. Nos. 3,650,757 and 4,242,445. If the grains are fed in an increased density or at an increased speed, the amount added will increase linearly, quadratically, or more drastically, with the time of feeding the grains. It would be better to reduce the amount of silver halide used, as is required in some cases. In the case where two or more solutions of soluble silver salt or soluble halogen salt, which differ in composition, are added, these solutions can be added in different amounts.

To react the solution of soluble silver salt with that of soluble halogen salt, the known mixer can be employed. Examples of this mixer are disclosed in U.S. Pat. Nos. 2,996,287, 3,342,605, 3,415,650 and 3,785,777, and West German Laid-open Patent Applications 25 56 885 and 25 55 364.

Solvents for dissolving silver halide are useful for accelerating the ripening of the emulsion. As known in the art, an excessive amount of halogen ions is introduced in the reaction vessel, thereby to accelerate the ripening. Any other ripening agent can be used for the same purpose. The ripening agent can be applied in various manners. For example, it is added to the dispersion medium contained in the reaction vessel, before silver and halogenide salt are introduced into the vessel. Alternatively, it can be introduced into the reaction vessel, along with halogenide salt, silver salt, and deflocculant. Still alternatively, it can be introduced into the vessel independently of the halogenide salt and the silver salt.

Examples of such solvents are: ammonia; thiocyanate (e.g., potassium rhodanide or rhodan ammonium); organic thioether compound (e.g., those disclosed in U.S. Pat. Nos. 3,574,628, 3,021,215, 3,057,724, 3,038,805, 4,276,374, 4,297,439, 3,704,130 and 4,782,013, JP-A-57-104926); thione compound (e.g., tetra-substituted thiourea disclosed in JP-A-53-82408, JP-A-55-77737, and U.S. Pat. No. 4,221,863, or the compound disclosed in JP-A-53-144319); mercapto compound which can accelerate the growth of silver halide grains (e.g., the compound disclosed in JP-A-57-202531); and amine compound (e.g., the compound disclosed in JP-A54-100717).

Gelatin is suitable for use in the emulsion of the invention, as protective colloid and as binder in a layer made of any other hydrophilic colloid layer. Also, any other hydrophilic colloid can be used.

Examples of other hydrophilic colloid are: proteins such as graft polymer of gelatin and high-molecular substance, albumin, and casein; cellulose derivatives such as hydroxyethyl cellulose, carboxymethyl cellulose, and cellulose sulfate ester; sugar derivatives such as sodium arginate and starch derivative; and synthetic hydrophilic high-molecular substances such as monopolymer and copolymer (e.g., polyvinyl alcohol, polyvinyl partial acetal, poly-N-vinylpyrrolidone, polyacrylic acid, polymethacrylic acid, polyacrylamide, polyvinylimidazole and polyvinylpyrazole).

Gelatin can not only be lime-treated gelatin, but also acid-treated gelatin or such an enzyme-treated gelatin as is disclosed in Bull. Soc. Sci. Photo. Japan, No. 16, p. 30 (1966). Also, a substance obtained by hydrolyzing gelatin or by decomposing gelatin with an enzyme.

It is desirable that the emulsion of the invention be washed with water to be desalted and then be dispersed in a protective colloid newly prepared. The emulsion can be water-washed at any temperature selected in accordance with its use, but preferably at 5° C. to 50° C. It can be water-washed at any pH value selected for its application, but preferably at a pH value ranging from 2 to 10, more preferably at a pH value ranging from 3 to 8. Also, any value can be selected for the pAg at the time of the water-washing, in accordance with the use of the emulsion, but a preferable pAg value is 5 to 10. Further, the emulsion can be washed with water by any known method, such as noodle water-washing, dialysis, centrifugal separation, precipitation, or ion exchange. In the case of coagulation, use can be made of a sulfate, an organic solvent, a water-soluble polymer, or a gelatin derivative.

It is desirable, depending on the use of the emulsion, that metal ions be present during the forming of grains, the desalting, or the chemical sensitization, or before the coating of the emulsion. To dope the metal ions in the grains, the ions should better be added prior to the forming of the grains. To use the ions to modify the grain surface or as chemical sensitizer, they should be better be added after the forming of the grains and before the completion of the chemical sensitization. Metal ions can be doped in the entire grain, in only the core thereof, in only the shell thereof, or in only the epitaxial portion thereof, or only the base grain only. Examples of the metal are: Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, Bi, and the like. These metals can be added in the form of any salt that can be dissolved during the forming of the grains, such as ammonium salt, acetate, nitrate, sulfate, phosphate, hydrate, 6-membered complex salt, or 4-membered complex salt. Specific example of this salt are: $CdBr_2$, $CdCl_2$, $Cd(NO_3)_2$, $Pb(NO_3)_2$, $Pb(CH_3COO)_2$, $K_3[Fe(CN)_6]$, $(NH_4)_4$ $[Fe(CN)_6]$, $K_3IrCl_6$, $(NH_4)_3RhCl_6$, $K_4Ru(CN)_6$, and the like. The ligand of ordination compound can be selected from the group consisting of halo, aquo, cyano, cyanate, thiocyanate, nitrosyl, thionitrosyl, oxo, and carbonyl. Only one of these metal compounds is used, or two or three, or more of these can be used in combination.

It is desirable that the metal compound or compounds be dissolved in an appropriate solvent such as methanol or acetone, and the resultant solution be added to the emulsion. To stabilize the solution, aqueous solution of a halogenated compound (e.g., HCl or HBr), or halogenated alkali (e.g., KCl, NaCl, KBr, or NaBr) can be added to the solution. Further, acid or alkali can be added to the solution, if necessary. The metal compounds can be supplied into to the reaction vessel, either before or during the forming of the silver halide grains. Alternatively, the metal compounds can be added to aqueous solution of a water-soluble silver salt (e.g., $AgNO_3$) or a halogenated alkali (e.g., NaCl, KBr or KI), and the resultant solution can be continuously supplied into the reaction vessel during the forming of the silver halide grains. Also, a solution containing the metal compounds can be prepared and continuously introduced into the reaction vessel during a proper phase of the grain-forming period. It is also preferable that the metal compounds be added by a combination of various methods.

A method in which chalcogen is added during the forming of the grains is useful in some cases. Such a method is disclosed in U.S. Pat. No. 3,772,031.

According to the invention, silver halide grains can be chemically sensitized at any time during the preparation of the emulsion. Preferably, two or more sensitizations are utilized in combination. The sensitization or sensitizations can be performed at various times, thereby preparing emulsions of different types. Among these types of emulsions are: an emulsion which contains grains each having chemically sensitizing nuclei in the central part; an emulsion which contains grains each having chemically sensitizing nuclei in the near-surface region; and an emulsion which contains grains each having chemically sensitizing nuclei embedded in the surface. Of these emulsions, one containing grains each having chemically sensitizing nuclei of at least one type embedded in the near-surface region.

The silver halide grains can be chemically sensitized in the presence of a so-called "chemical sensitization aid." Useful as chemical sensitization aids are compounds which control the fog during the chemical sensitization and increase the sensitivity, such as azaindene, azapyridadine, azapyrimidine. Also, an agent for modifying the chemical sensitization aid can used along with the chemical sensitization aid. Examples of such a modifying agent are disclosed in U.S. Pat. Nos. 2,131,038, 3,411,914 and 3,554,757, JP-A-58-126526, and Duffin, "Photographic Emulsion Chemistry," pp. 138–143.

It is desirable that an oxidizing agent be used for oxidizing silver during the preparation of the emulsion. The silver-oxidizing agent is a compound which acts on silver, thus forming silver ions. Effective as such an oxidizing agent are compounds which convert the fine silver grains formed during the forming of silver halide grains or the chemical sensitization thereof, into silver ions. The silver ions, thus formed, can form a silver salt which can hardly be dissolved in water, such as silver halide, silver sulfate, and silver selenide. The silver-oxidizing agent can be an inorganic one or an organic one. Examples of the inorganic oxidizing agent are; ozone, hydrogen peroxide, adduct thereof (e.g., $NaBO_2.N_2O_2.{}_3H_2O$, $2NaCO3.3H_2O_2$, $Na_4P_2O_7.2H_2O_2$, or $2Na_2SO_4.H_2O_2.2H_2O$), salt of peroxy acid (e.g., $K_2S_2O_8$, $K_2C_2O_6$, or $K_2P_2O_8$), peroxy complex salt (e.g., $K_2(Ti(O_2)C_2O_4].3H_2O$, $4K_2SO_4.Ti(O_2)OH.SO_4.2H_2O$, or $Na_3[VO(O_2)(C_2H_4)_2].6H_2O$), oxyacid salt such as permanganate (e.g., $KMnO_4$) or chromate (e.g., $K_2Cr_2O_7$), halogen element such as iodine or bromine, perhalogenate (e.g., potassium perhaloganate), salt of high-valence metal (e.g., potassium hexacyanoferrate (II), and thiosulfonate.

Examples of the organic oxidizing agent are: quinones such as p-quinone, organic peroxides such as peracetic acid or perbenzoic acid, compounds releasing active halogen (e.g., N-bromosuccinimide, chloramine-T, and chloramine-B).

Preferable as oxidizing agent for use in this invention are: ozone, hydrogen peroxide, adduct thereof, halogen element and thiosulfonate, which are inorganic oxidizing agents, and quiones which are organic oxidizing agents. It is preferable that the reduction sensitizer and the silver-oxidizing agent be used together. The reduction sensitizer can be added before or after the silver-oxidizing agent is applied, or simultaneously with the silver-oxidizing agent. The reduction sensitizer and the silver oxidizing agent can be applied during the forming of the grains or during the chemical sensitization.

The photographic emulsion used in the invention can contain various compounds to prevent fogging from occurring during the manufacture, storage or processing of the light-sensitive material, and to stabilize the photographic properties of the light-sensitive material. More precisely, compounds known as antifoggants and stabilizing agents can be added to the emulsion. Examples of these compounds are: thiazoles such as benzothiazolium salt; nitroimidazoles; nitrobenzimidazoles; chlorobenzimidazoles; bromobenzimidazoles; mercapto thiazoles; mercapto benzothiazoles; mercapto benzimidazoles; mercapto thiadiazoles; aminotriazoles; benzotriazoles; nitrobenzotriazoles; mercapto tetrazoles, particularly, 1-phenyl-5-mercapto tetrazole; mercapto pyrimidines; mercapto triazines; thioketo compounds such as oxadolinethlone; azaindenes such as triazaindene and tetrazaindene (particularly, 4-hydroxy-substituted (1, 3, 3a, 7) tetraazaindenes); pentaazaindenes. The compounds disclosed in, for example, U.S. Pat. Nos. 3,954,474 and 3,982,947 and JP-B-52-28660 can be used as antifoggants and stabilizing agents. One of compounds which are preferable for use in the invention is disclosed in JP-A-63-212932. These antifoggants and stabilizing agents can be added before, during or after the forming of grains, during water-washing, during the dispersion process subsequent to the water-washing, before, during or after chemical sensitization, or before coating process, in accordance with the purpose for which the antifoggants and the stabilizing agents are used. The antifoggants and the stabilizing agents can be used, not only to prevent fogging and stabilize the photographic properties of the light-sensitive material, but also to control the crystal habit of the grains, reduce the grain size, decrease the solubility of the grain, control the chemical sensitization, and modify the arrangement of dye particles.

It is desirable that the photographic emulsion used in the invention be spectrally sensitized with methine dyes or the like, thereby to achieve the advantages expected of the present invention. Examples of the dyes used are: cyanine dye, melocyanine dye, composite cyanine dye, composite melocyanine dye, holopolar cyanine dye, hemicyanine dye, styrly dye, and hemioxonol dye. Of these dyes, particularly useful are cyanine dye, melocyanine dye, and composite melocyanine dye. These dyes contain nuclei which are usually used in cyanine dyes as basic heterocyclic nuclei. Examples of the nuclei are nuclei such as pyrroline, oxazoline, thiazoline, pyrrole, oxazole, thiazole, selenazole, imidazole, teterazole, and pyridine; nuclei each formed of any one of these nuclei and an alicylic hydrocarbon ring fused to the nucleus; and nuclei each formed of any one of these nuclei and an aromatic hydrocarbon ring fused to the nucleus, such as indolenine, benzindolenine, indole, benzoxazole, naphthoxazole, benzothiazole, naphthothiazole, benzoselenazole, benzimidazole, and quinoline. These nuclei can be substituted at carbon atoms.

Melocyanine dye or composite melocyanine dye can be one which has nuclei of ketomethylene structure. Applicable as such nuclei are 5- or 6-membered heterocyclic nuclei of pyrazoline-5-on, thiohydantoin, 2-thiooxazoline-2,4-dione, thiazolidine-2,4-dione, rhodanine or thiobarbituric acid.

These sensitizing dyes can be used, either singly or in combination. In many cases, they are used in combination, for achieving supersensitization, as is disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618, and JP-A-52-109925.

According to the present invention, the emulsion can contain not only the sensitizing dye, but also a dye which has no sensitizing ability or a substance which absorbs virtually no visible light and has supersensitizing ability.

The sensitizing dye can be added at any time during the preparation of any emulsion that has been hitherto known as useful. In most cases, the dye is added after the chemical sensitization and before the coating of the emulsion. However, it can be added at the same time the chemical sensitizer is added, thereby to accomplish spectral sensitization and chemical sensitization at the same time, as is disclosed in U.S. Pat. Nos. 3,628,969 and 4,225,666. Alternatively, it can be added before the chemical sensitization, to initiate spectral sensitization, as is described in JP-A-58-113928. Also, it can be added before the precipitation of silver halide grains, to initiate spectral sensitization. Still alternatively, it can be added in two portions before and after chemical sensitization, respectively, as is disclosed in U.S. Pat. No. 4,225,666. Moreover, it can be added at any time during the forming of silver halide grains, as is described in U.S. Pat. No. 4,183,756.

The amount in which to add the sensitizing dye is $4\times10^{-6}$ to $8\times10^{-3}$ mol per mol of silver halide used. Preferably, the dye is added in an amount of $5\times10^{-5}$ to $2\times10^{-3}$ mol per mol of silver halide, in the case the silver halide grains used have sizes ranging from 0.2 to 1.2 μm.

Not only the additives described above, but also other additives are used in the light-sensitive material according to the invention, in accordance to the application of the material. These additives are described in Research Disclosure Item 17643 (December 1978), Research Disclosure Item 18716 (November 1979), and Research Disclosure Item 308119 (December 1989), as is listed in the following table:

| Additives | RD17643 | RD18716 | RD308119 |
|---|---|---|---|
| 1. Chemical sensitizers | page 23 | page 648, right column | page 966 |
| 2. Sensitivity increasing agents | | page 648, right column | |
| 3. Spectral Sensitizers, super sensitizers | page 23–24 | page 648, right column to page 649, right column | page 966, right column to page 988, right column |
| 4. Brighteners | page 24 | | page 998, right column |
| 5. Antifoggants and stabilizers | page 24–25 | page 649, right column | page 988, right column to page 1000, right column |
| 6. Light absorbent, filter dye, ultraviolet absorbents | page 25–26 | page 649, right column to page 650, left column | page 1003, left to column to page 1003, right column |
| 7. Stain preventing agents | page 25, right column | page 650, left to right columns | |
| 8. Dye image | page 25 | | |
| 9. Hardening agents | page 26 | page 615, left column | page 1004, right column to page 1005, left column |
| 10. Binder | page 26 | page 651, left coloum | page 1003, right column to page 1004, |

-continued

| Additives | RD17643 | RD18716 | RD308119 |
|---|---|---|---|
| | | | right colulmn |
| 11. Plasticizers, lubricants | page 27 | page 650, right column | page 1006, left coumn to page 1006, right column |
| 12. Coating aids, surface active agents | page 26–27 | page 650, right column | page 1005, left co column to pp. 1006, left column |
| 13. Antistatic agents | page 27 | page 650, right column | pp. 1006, left column to pp. 1007, left column |

The multilayered color light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one light-sensitive layers constituted by a plurality of silver halide emulsion layers which are sensitive to essentially the same color sensitivity but has different sensitivities. The light-sensitive layers are unit light-sensitive layer sensitive to blue, green or red. In a multi layered silver halide color photographic light-sensitive material, the unit light-sensitive layers are generally arranged such that red-, green-, and blue-sensitive layers are formed from a support side in the order named. However, this order may be reversed or a layer sensitive to one color may be sandwiched between layers sensitive to another color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a layer sensitive to one color as described in JP-A-59-202464.

Also, an order of, for example, high-sensitivity emulsion layer/low-sensitivity emulsion layer/medium-sensitivity emulsion layer, or low-sensitivity emulsion layer/medium-sensitivity emulsion layer/high-sensitivity emulsion layer may be adopted.

Furthermore, the arrangement can be changed as described above even when four or more layers are formed.

As described above, various layer types and arrangements can be selected in accordance with the application of the light-sensitive material.

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected surface areas) of the fine grain silver halide is preferably 0.01 to 0.5 μm, and more preferably, 0.02 to 0.2 μm.

The fine grain silver halide can be prepared by a method similar to a method of preparing normal light-sensitive material silver halide. In this preparation, the surface of a silver halide grain need not be subjected to either optical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain containing layer preferably contains a colloidal silver.

A coating silver amount of the light-sensitive material of the present invention is preferably 7.0 g/m$^2$ or less, and most preferably, 4.5 g/m$^2$ or less.

In order to prevent degradation in photographic properties caused by formaldehyde gas, a compound described in U.S. Pat. Nos. 4,411,987 or 4,435,503, which can react with formaldehyde and fix the same, is preferably added to the light-sensitive material.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains compounds for releasing a fogging agent, a development accelerator, a silver halide solvent, or precursors thereof described in JP-A-1-106052 regardless of a developed silver amount produced by the development.

The light-sensitive material of the present invention preferably contains dyes dispersed by methods described in WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in above-mentioned Research Disclosure (RD), No. 17643, VII-C to VII-G and RD No. 307105, VII-C to VII-G.

Preferable examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, the compounds described in, e.g., U.S. Pat. Nos. 4,310,619 and 4,351,897, European Patent 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO No. 88/04795.

Examples of a cyan coupler are phenol and naphthol couplers. Of these, preferable are those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Laid-open Patent Application 3,329,729, European Patents 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

Typical examples of a polymerized dye-forming coupler are described in U.S. Pat. Nos. 3,451,820, 4,080,221, 4,367,282, 4,409,320, and 4,576,910, British Patent 2,102,173, and EP 341,188A.

Preferable examples of a coupler capable of forming colored dyes having proper diffusibility are those described in U.S. Pat. No. 4,366,237, British Patent 2,125,570, EP 96,570, and West German Laid-open Patent Application No. 3,234,533.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Compounds releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler for imagewise releasing a nucleating agent or a development accelerator are described in British Patents 2,097,140 and 2,131,188, JP-A-59-157638, and JP-A-59-170840. In addition, compounds for releasing a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; bleaching accelerator releasing couplers described in, e.g., RD. No. 11449 and 24241 and JP-A-61-201247; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be added to the light-sensitive material by various known dispersion methods.

Examples of a high-boiling organic solvent to be used in the oil-in-water dispersion method are described in, for example, U.S. Pat. No. 2,322,027.

Examples of a high-boiling organic solvent to be used in the oil-in-water dispersion method and having a boiling point of 175° C. or more at atmospheric pressure are phthalate esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate); phosphate or phosphonate esters (e.g., triphenylphosphate, tricresylphosphate, 2-ethylhexyl diphenylphosphate, tricyclohexylphosphate, tri-2-ethylhexylphosphate, tridodecylphosphate, tributoxyethylphosphate, trichloropropylphosphate, and di-2-ethyl hexylphenylphosphonate); benzoate esters (e.g., 2-ethylhexylbenzoate, dodecylbenzoate, and 2-ethylhexyl-p-hydroxybenzoate); amides (e.g., N,N-diethyldodecane amide, N,N-diethyllaurylamide, and N-tetradecylpyrrolidone); alcohols or phenols (e.g., isostearylalcohol and 2,4-di-tert-amylphenol), aliphatic carboxylate esters (e.g., bis(2-ethylhexyl) sebacate, dioctylazelate, glyceroltributylate, isostearyllactate, and trioctylcitrate); aniline derivative (e.g., N,N-dibutyl-2-butoxy-5-tert-octylaniline); and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a loadable latex are described in, e.g., U.S. Pat.

No. 4,199,363 and German Laid-open Patent Application Nos. 2,541,274 and 2,541,230.

Various types of antiseptics and fungicides agent are preferably added to the color light-sensitive material of the present invention. Examples of the antiseptics and the fungicides are phenetyl alcohol, and 1,2-benzisothiazoline-3-one, n-butyl-p-hydroxybenzoate, phenol, 4-chloro-3,5-dimethylphenol, 2-phenoxyethanol, and 2-(4-thiazolyl) benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed T½ is preferably 30 sec. or less, and more preferably, 20 sec. or less. The film thickness means a film thickness measured under moisture conditioning at a temperature of 25° C. and a relative humidity of 55% (two days). The film swell speed T½ can be measured in accordance with a known method in the art. For example, the film swell speed T½ can be measured by using a swell meter described in A. Green et al., "Photographic Science & Engineering," Vol. 19, No. 2, pp. 124 to 129. When 90% of a maximum swell film thickness reached by performing a treatment by using a color developing agent at 30° C. for 3 min. and 15 sec. is defined as a saturated film thickness, T½ is defined as a time required for reaching ½ of the saturated film thickness.

The film swell speed T½ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness–film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamide ethylaniline, 3-methyl-4-amino-N-ethyl-N-β-methoxyethyl aniline, and sulfates, hydrochlorides and p-toluene sulfonates thereof. Of these compounds, 3-methyl-4-amino-N-ethyl-N-β-hydroxyethyl aniline, 4-amino-3-methyl-N-ethyl-N-(3-hydroxypropyl) aniline is preferred in particular. These compounds can be used in a combination of two or more thereof in accordance with the application.

In general, the color developer contains a pH buffering agent such as a carbonate, a borate, or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, sulfites, a hydrazine such as N,N-biscarboxymethyl hydrazine, a phenylsemicarbazide, triethanolamine, or a catechol sulfonic acid; an organic solvent such as ethyleneglycol or diethyleneglycol; a development accelerator such as benzyl alcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenedi amine-N,N,N,N-tetramethylenephosphonic acid, and ethylenediamine-di(O-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be singly or in a combination of two or more thereof. The pH of the color and black-and-white developers is generally 9 to 12. Although the quantity of replenisher of the developer depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. In order to decrease the quantity of the replenisher, a contact area of a processing tank with air is preferably decreased to prevent evaporation and oxidation of the solution upon contact with air.

The contact area of the solution with air in a processing tank can be represented by an aperture defined below:

Aperture=[contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal, e.g., iron(III), peroxides; quinones; and a nitro compound. Typical examples of the bleaching agent are an organic complex salt of iron(III), e.g., a complex salt of an aminopolycarboxylic acid such as ethylenediamine-tetraacetic acid, diethylenetriaminepentaacetic acid, cyclohexanediamine-tetraacetic acid, methyliminodiacetic acid, and 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopoly carboxylic acid is normally 4 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426, and Research Disclosure No. 17,129 (July, 1978); a thiazolidine derivative described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds descried in West German Patents 966,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light- sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid or propionic acid.

Examples of the fixing solution or the bleach-fixing solution are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the fixing solution or the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of desilvering step is preferably as short as possible as long as no desilvering defect occurs. A preferable time is 1 to 3 minutes, and more preferably, one to two minutes. A processing tempera ture is 25° C. to 50° C., and preferably, 35° C. to 45° C. Within the preferable temperature range, a desilvering speed is increased, and generation of a stain after the processing can be effectively prevented.

In the desilvering step, stirring should be performed as strongly as is possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, pp. 248–253 (May, 1955).

In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are formalin, an aldehyde such as glutaraldehyde, an N-methylol compound, hexamethylenetetramine, and an adduct of aldehyde sulfite.

Various cheleting agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in, for example, JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can also be applied to thermal development light-sensitive materials described in, e.g., U.S. Pat. No. 4,500,626, JP-A-60-133449, JP-A-59-218443, JP-A-61-238056, and EP210,660A2.

The present invention will be described in more detail below by way of its examples, but the present invention is not limited to these examples.

EXAMPLES

EXAMPLE 1

First, a monodispersed emulsion was prepared which contained double-structured octahedral grains slightly rounded and having an average iodine content of 12 mol %, an average size of 1.1 μm, and a variation coefficient of 15% in terms of size distribution. The cores of the grains had an iodine content of 24 mol %, and the shells covering up the cores had an iodine content of 0 mol %. The emulsion was desilvered by means or the ordinary flocculation, thereby obtaining emulsion A.

Three emulsions B, C, and D were prepared which were identical to emulsion A, except that their variation coefficients were 20%, 24% and 32%, respectively.

These emulsions, which is not chemically sensitized, A, B, C, an D were chemically sensitized at 61° C. with auric chloride, potassium thio cyanate, and the sulfur sensitizers and/or tellurium sensitizers shown in Table 1 (later presented), so that they might have optimum sensitivities when exposed for 1/100 second.

Emulsions A, B, C, and D, thus chemically sensitized, were coated on film supports, thereby preparing Samples 1 to 16.

More specifically, each sample comprised an undercoated triacetylcellulose film support, an emulsion layer, and a protective layer, both layers having been formed on the support simultaneously. The emulsion layer contained any one of emulsions A to D (silver content: $1.5\times10^{-2}$ mol/m$^2$), the coupler represented by the following formula, used in an amount of $1.5\times10^{-3}$ mol/m$^2$, a stabilizing agent, a coating aid, and gelatin. The protective layer contained gelatin, a film hardener, a coating aid, and a matting agent.

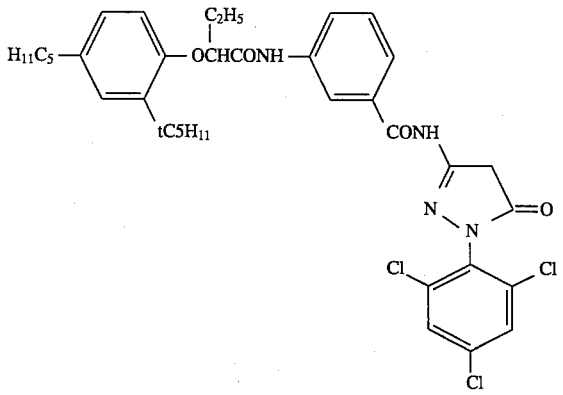

Samples 1 to 16 were exposed to light for sensitometry and then color-developed. Their densities were measured by means of a green filter. Samples 1 to 16 exhibited the photographic properties, which are shown in Table 1.

The development process was performed at 38° C. under the following conditions:

| | | |
|---|---|---|
| 1. | Color developing: | 1 min. 45 sec. |
| 2. | Bleaching: | 6 min. 30 sec. |
| 3. | Water-washing: | 3 min. 15 sec. |
| 4. | Fixing: | 6 min. 30 sec. |
| 5. | Water-washing: | 3 min. 15 sec. |
| 6. | Stabilizing: | 3 min. 15 sec. |

The solutions used in the processing steps specified above had the following compositions:

| | |
|---|---|
| Color developing solution | |
| Sodium nitrilotetraacetate | 1.4 g |
| Sodium sulfite | 4.0 g |
| Sodium carbonate | 30.0 g |
| Potassium bromide | 1.4 g |
| Hydroxyamine sulfate | 2.4 g |
| 4-(N-ethyl-N-β-hydroxy-ethylamino)-2-methyl-aniline sulfate | 4.5 g |
| Water to make | 1 liter |
| Bleaching Solution | |
| Ammonium bromide | 160.0 g |
| Ammonia water (28%) | 25.0 ml |
| Sodium ethylenediamine tetraacetoferrate (III) | 130 g |
| Glacial acetic acid | 14 ml |
| Water to make | 1 liter |
| Fixing Solution | |
| Sodium tetrapolyphosphate | 2.0 g |

-continued

| | |
|---|---|
| Sodium sulfite | 4.0 g |
| Ammonium thiosulfate (70%) | 175.0 ml |
| Sodium bisulfate | 4.6 g |
| Water to make | 1 liter |

Samples 1 to 16 were subjected to wedge exposure for 1/100 second. The light source used in the wedge exposure was a filter adjusted to a color temperature of 4800° K. The sensitivities of the samples were compared at an optical density of 0.2, using that, i.e., 100, of Sample 1 as reference.

The gradations of Samples 1 to 16 were compared, with that, i.e., 1.0, of Sample 1 used as reference. The gradation of each sample was evaluated in terms of the inclination of the straight line connecting two points on the fog-characteristic curve, which indicated optical densities of 0.2 and 1.0, respectively.

Further, to evaluate the fog occurring during the storage of each sample, the sample was left to stand for 7 days in atmosphere at temperature of 50° C. and relative humidity of 60%, and thereafter was processed under the same conditions as specified above. The fog of the sample was measured and compared with the fog the sample had immediately after it had been prepared. The difference in fog, thus obtained, was recorded as change occurring during the storage.

The results of this test were as is shown in the following Table 1.

TABLE 1

| Sample No. | Emulsion (not chemically sensitized) | Sensitizer | | Fog | Sensitivity | Gradation | Change in Fog |
|---|---|---|---|---|---|---|---|
| 1 | A | Sodium thiosulfate | Comparative Example | 0.08 | 100 | 1.00 | 0.20 |
| 2 | " | Compound 10 | Present Invention | 0.14 | 180 | 1.30 | 0.30 |

TABLE 1-continued

| Sample No. | Emulsion (not chemically sensitized) | Sensitizer | | Fog | Sensitivity | Gradation | Change in Fog |
|---|---|---|---|---|---|---|---|
| 3 | " | Compound 10 and sodium thiosulfate | Present Invention | 0.09 | 165 | 1.50 | 0.25 |
| 4 | " | Compound 12 and sodium thiosulfate | Present Invention | 0.10 | 168 | 1.48 | 0.27 |
| 5 | B | Sodium thiosulfate | Comparative Example | 0.09 | 105 | 0.95 | 0.21 |
| 6 | " | Compound 10 | Present Invention | 0.16 | 185 | 1.25 | 0.32 |
| 7 | " | Compound 10 and sodium thiosulfate | Present Invention | 0.12 | 167 | 1.45 | 0.26 |
| 8 | " | Compound 31 and sodium thiosulfate | Present Invention | 0.11 | 150 | 1.35 | 0.21 |
| 9 | C | Sodium thiosulfate | Comparative Example | 0.07 | 107 | 0.90 | 0.19 |
| 10 | " | Compound 10 | Present Invention | 0.17 | 186 | 1.20 | 0.33 |
| 11 | C | Compound 10 and sodium thiosulfate | Present Invention | 0.14 | 166 | 1.40 | 0.27 |
| 12 | " | K2 Te and sodium thiosulfate | Present Invention | 0.20 | 145 | 1.30 | 0.38 |
| 13 | D | Sodium thiosulfate | Comparative Example | 0.08 | 110 | 0.80 | 0.22 |
| 14 | " | Compound 10 | Comparative Example | 0.35 | 115 | 0.75 | 0.60 |
| 15 | " | Compound 10 and sodium thiosulfate | Comparative Example | 0.28 | 120 | 0.82 | 0.45 |
| 16 | " | Compound 12 and sodium thiosulfate | Comparative Example | 0.30 | 118 | 0.81 | 0.46 |

As is evident from Table 1, the usefulness of the present invention is obvious, as will be discussed.

Samples 14 to 16, which contained a tellurium-sensitized polydispersed emulsion, was more sensitive than Sample 13 which contained a sulfur-sensitized emulsion. However, they had much fog and a great change in fog, and their gradations were not so high. Further, Samples 14 to 16 demonstrated no advantage which might resulted from the combination of sulfur sensitization and tellurium sensitization.

By contrast, Samples 2 to 4, 6 to 8, and 10 to 12, which fall within the scope of the invention, had not only a relatively small fog and a small change in fog, but also a high sensitivity and a great gradation.

Comparison of Samples 2, 6, and 10 with Samples 3, 7, and 11, respectively, reveals that a monodispersed emulsion having a variation coefficient of 22% or less is preferred, and that a monodispersed emulsion having a variation coefficient of 18% is more preferred.

Comparison of Sample 11 with 12 shows that the tellurium sensitizer represented by the formula (I) is superior to those disclosed in Canadian Patent 800,958 and British Patent 1,295,462. (Similarly, comparison of Samples 7, 8, 11, and 12 proves that the compound of the formula (II) is also excellent.)

Also, as is clearly seen from the photographic properties of Samples 2 with 3, 6 with 7, and 10 with 11, the combined application of a sulfur sensitizer and a tellurium sensitizer helped to increase gradation and decrease fog, though it decreased sensitivity a little.

EXAMPLE 2

A monodispersed emulsion was prepared which contained triple-structured octahedral grains slightly rounded and having an average iodine content of 4 mol % and an average size of 0.6 μm. The cores of the grains had an iodine content of 1 mol %, the inner shells covering up the cores had an iodine content of 38 mol %, the outer shells had an iodine content of 1 mol %. The emulsion was subjected to the same experiment as in Example 1, except that it was chemically sensitized in the presence of appropriate amounts of the three sensitizing dyes specified below.

The use of this emulsion was found to achieve the same advantage as accomplished in Example 1.

Sensitizing Dye I

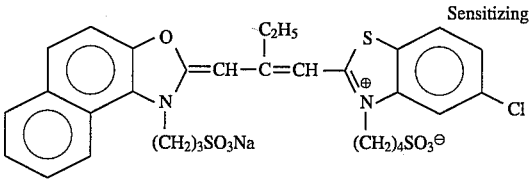

Sensitizing Dye II

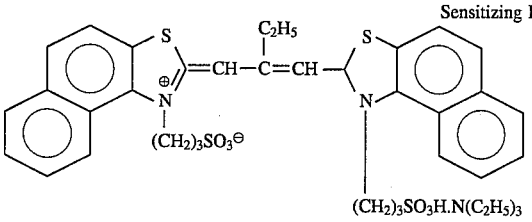

-continued

Sensitizing Dye III

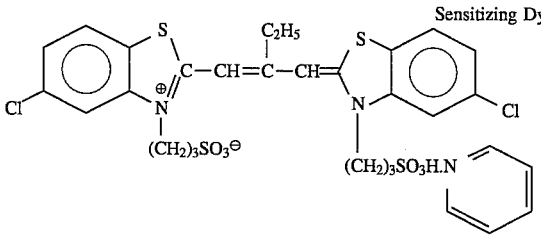

EXAMPLE 3

A monodispersed emulsion was prepared which contained triple-structured octahedral grains slightly rounded and having an average iodine content of 5 mol % and an average size of 0.35 μm. The cores of the grains were formed of silver bromide, the inner shells covering up the cores were made of silver iodobromide and having an iodine content of 38 mol %, and the outer shells were made of silver iodide. The emulsion was subjected to the same experiment as in Example 1, except that it was chemically sensitized in the presence of an appropriate amount of 4-hydroxy-6-methyl-1,3,3a,7-tetraazaindene. The emulsion also established the usefulness of the present invention.

EXAMPLE 4

An emulsion was prepared which contained tabular grains having an average iodine content of 8.8 mol %, an average aspect ratio of 7.2 and an equivalent-sphere diameter of 0.65 μm and having dislocation lines. The emulsion was put to the same experiment as in Example 1, and established the usefulness of the present invention.

EXAMPLE 5

The following experiment was conducted in accordance with the instructions disclosed in JP-A-61-67845.

An emulsion was prepared by means of double-jet method, which contained tetradecahedral silver halide grains having an average size of 1.5 μm, and an average variation coefficient of 12%. The cores of the grains had a silver iodide content of 2 mol %, and the shells thereof had a thickness of 0.3 μm and a silver iodide of 0.5 mol %. The emulsion was divided into two portions. The first portion was chemically sensitized and spectrally sensitized with dimethylselenourea as emulsion D used in Example 1 disclosed in JP-A-61-67845 and was coated on a support, thereby preparing Sample 51. The second portion of the emulsion was processed in the same way as the first portion, except that compound 10 was used in place of dimethylselenourea, thereby preparing Sample 52.

Samples 51 and 52 were put to sensitometry test, the results of which were as is represented in the following Table 2. The sensitivity and gradation of each sample, shown in Table 2, are of relative values, with those of Sample 51, i.e., 100 and 1.0, respectively, used as reference.

TABLE 2

| Sample No. | Fog | Sensitivity | Gradation |
|---|---|---|---|
| 51 | 0.07 | 100 | 1.0 |
| 52 | 0.09 | 115 | 1.30 |

As is obvious from Table 2, the present invention is useful.

EXAMPLE 6

Various layers were coated on an undercoated triacetylcellulose film support, forming a multilayered color light-sensitive material (hereinafter referred to as "Sample 101").

(Compositions of light-sensitive layers)

Numerals corresponding to each component indicates a coating amount represented in units of g/m$^2$. The coating amount of a silver halide is represented by the coating amount of silver. The coating amount of a sensitizing dye is represented in units of moles per mole of a silver halide in the same layer.

| (Sample 101) | |
|---|---|
| Layer 1: Antihalation layer | |
| Black colloidal silver | silver 0.18 |
| Gelatin | 0.40 |
| Layer 2: Interlayer | |
| 2,5-di-t-pentadecylhydorquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 0.04 |
| Layer 3: First red-sensitive emulsion layer | |
| Emulsion A | silver 0.25 |
| Emulsion B | silver 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.17 |
| EX-10 | 0.020 |
| EX-14 | 0.17 |
| U-1 | 0.070 |
| U-2 | 0.050 |
| U-3 | 0.070 |
| HBS-1 | 0.060 |
| Gelatin | 0.87 |
| Layer 4: Second red-sensitive emulsion layer | |
| Emulsion G | silver 1.00 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.20 |
| EX-3 | 0.050 |
| EX-10 | 0.015 |
| EX-14 | 0.20 |
| EX-15 | 0.050 |
| U-1 | 0.070 |
| U-2 | 0.050 |
| U-3 | 0.070 |
| Gelatin | 1.30 |
| Layer 5: Third red-sensitive emulsion layer | |
| Emulsion D | silver 1.60 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| Layer 6: Interlayer | |
| EX-5 | 0.040 |

-continued (Sample 101)

| | |
|---|---|
| HBS-1 | 0.020 |
| Gelatin | 0.80 |
| Layer 7: First green-sensitive emulsion layer | |
| Emulsion A | silver 0.15 |
| Emulsion B | silver 0.15 |
| Sensitizing dye IV | $3.0 \times 10^{-5}$ |
| Sensitizing dye v | $1.0 \times 10^{-4}$ |
| Sensitizing dye VI | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |
| Layer 8: Second green-sensitive emulsion layer | |
| Emulsion C | silver 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| Layer 9: Third green-sensitive emulsion layer | |
| Emulsion E | silver 1.20 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.013 |
| EX-11 | 0.065 |
| EX-13 | 0.019 |
| HBS-1 | 0.25 |
| HBS-2 | 0.10 |
| Gelatin | 1.54 |
| Layer 10: Yellow filter layer | |
| Yellow colloid silver | silver 0.050 |
| EX-5 | 0.080 |
| HBS-1 | 0.030 |
| Gelatin | 0.95 |
| Layer 11: First blue-sensitive emulsion layer | |
| Emulsion A | silver 0.080 |
| Emulsion B | silver 0.070 |
| Emulsion F | silver 0.070 |
| Sensitizing dye VII | $3.5 \times 10^{-4}$ |
| EX-8 | 0.042 |
| EX-9 | 0.72 |
| HBS-1 | 0.28 |
| Gelatin | 1.10 |
| Layer 12: Second blue-sensitive emulsion layer | |
| Emulsion G | silver 0.45 |
| Sensitizing dye VII | $2.1 \times 10^{-4}$ |
| EX-9 | 0.15 |
| EX-10 | $7.0 \times 10^{-3}$ |
| HBS-1 | 0.050 |
| Gelatin | 0.78 |
| Layer 13: Third blue-sensitive emulsion layer | |
| Emulsion H | silver 0.77 |
| Sensitizing dye VII | $2.2 \times 10^{-4}$ |
| EX-9 | 0.20 |
| HBS-1 | 0.070 |
| Gelatin | 0.69 |
| Layer 14: First protective layer | |
| Emulsion I | silver 0.20 |
| U-4 | 0.11 |
| U-5 | 0.17 |
| HBS-1 | $5.0 \times 10^{-2}$ |
| Gelatin | 1.00 |
| Layer 15: Second protective layer | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Formulas or names of the compounds used in the manufacture of the samples are listed in Table A.

Further, all layers of Sample 101 contained W-1, W-2, W-3, B-4, B-5, F-1, F-2, F-3, F-4, F-5, F-6, F-7, F-8, F-9, F-10, F-11, F-12, F-13, iron salt, lead salt, gold salt, platinum salt, iridium salt, and rohdium salt, so that they may have improved storage stability, may be more readily processed, may be more resistant to pressure, more antibacterial and more anti fungal, may be better protected against electrical charging, and may be more readily coated.

Emulsions A to I, used in preparing Sample 101, will be specified in Table 3, and the structures of the compounds used in Sample 101 will be shown below.

Emulsions D, B, and G for use in Sample 101 were replaced with others, as in Examples 1, 2, and 4, and the same test as described above was performed (except that the color developing time was changed to 3 min. 15 sec.).

The same advantages were achieved in Examples 1, 2, and 4 were attained in Sample 101 (i.e., a multilayered color light-sensitive material).

TABLE 3

| | Average AgI Content (%) | Average grain Size (μm) | Variation Coefficient Relating to Grain Size (%) | Diameter/ Thickness Ratio | Silver Amount Ratio (AgI Content %) |
|---|---|---|---|---|---|
| Emulsion A | 4.0 | 0.45 | 27 | 1 | Core/Shell = 1/3(13/1), Double structure grains |
| Emulsion B | 4.0 | 0.60 | 14 | 1 | Triple structure grains (see Example 2) |
| Emulsion C | 10 | 0.75 | 30 | 2 | Core/Shell = 1/2(24/3), Double structure grains |
| Emulsion D | 12 | 1.10 | 15 | 1 | Double structure grains (see Example 1) |
| Emulsion E | 10 | 1.05 | 35 | 3 | Core/Shell = 1/2(24/3), Double structure |

TABLE 3-continued

| | Average AgI Content (%) | Average grain Size (μm) | Variation Coefficient Relating to Grain Size (%) | Diameter/ Thickness Ratio | Silver Amount Ratio (AgI Content %) |
|---|---|---|---|---|---|
| | | | | | grains |
| Emulsion F | 4.0 | 0.25 | 28 | 1 | Core/Shell = 1/3(13/1), Double structure grains |
| Emulsion G | 8.8 | 0.65 | 20 | 7.2 | Tabular grains having dislocation line (see Example 4) |
| Emulsion H | 14.5 | 1.30 | 25 | 3 | Core/Shell = 37/63(34/3), Double structure grains |
| Emulsion I | 1.0 | 0.07 | 15 | 1 | Uniform grain |

TABLE A

EX-1

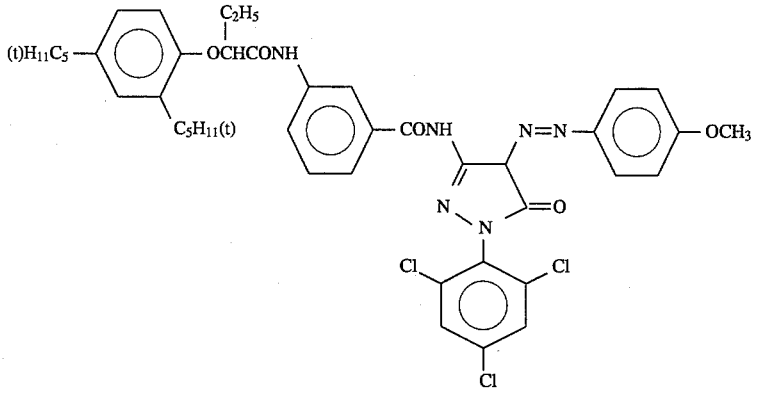

EX-2

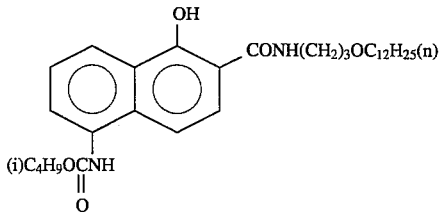

EX-3

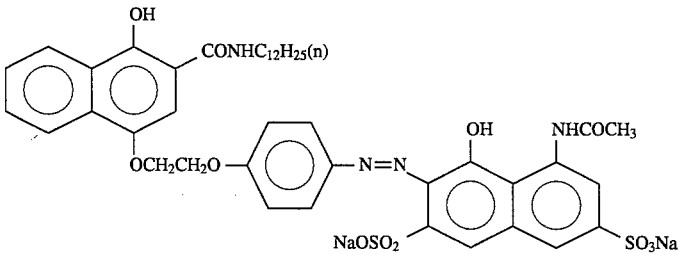

EX-4

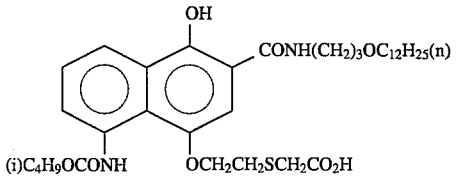

TABLE A-continued
EX-5
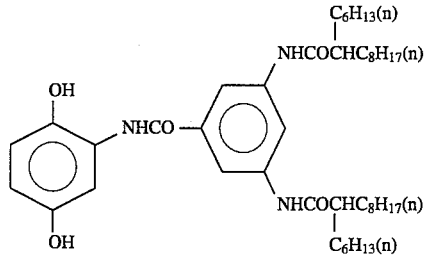
EX-6
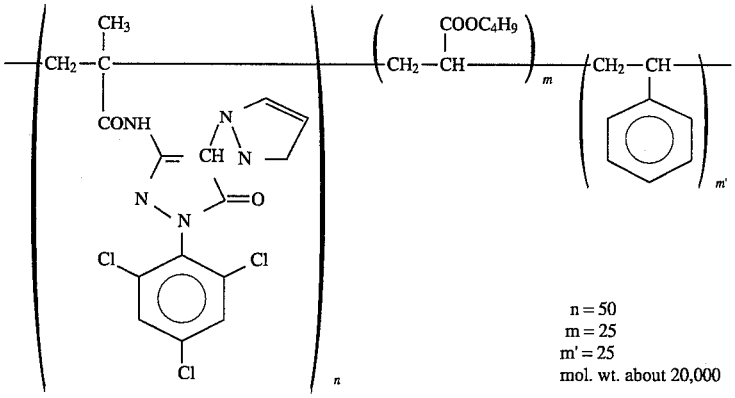
EX-7
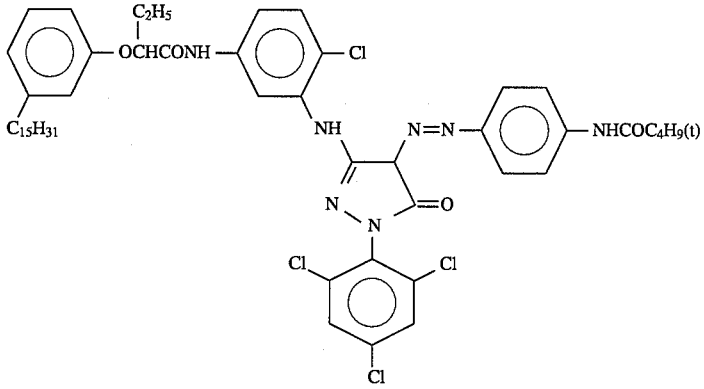
EX-8
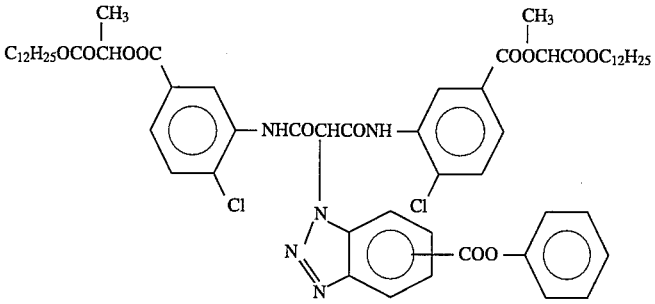
EX-9
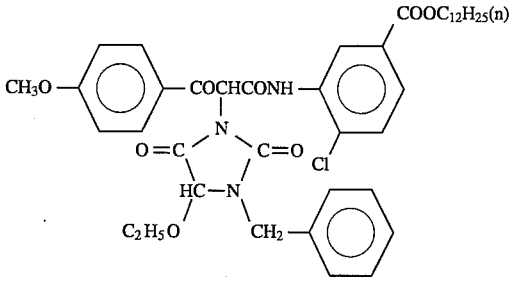

TABLE A-continued
EX-10
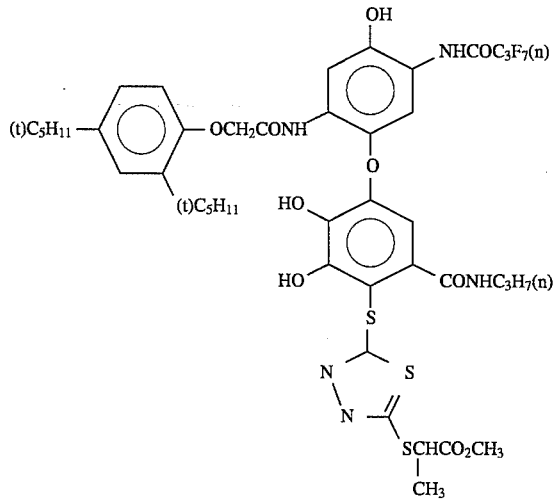
EX-11
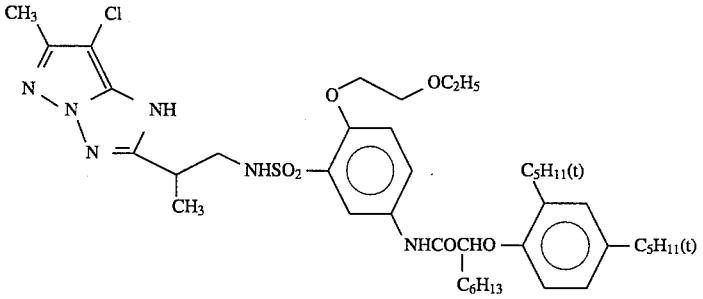
EX-12
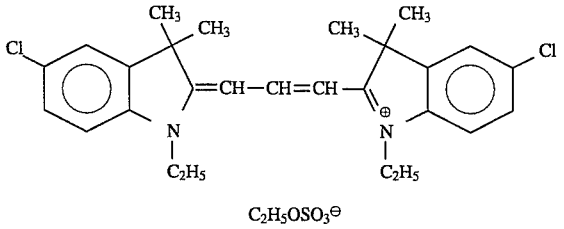
EX-14
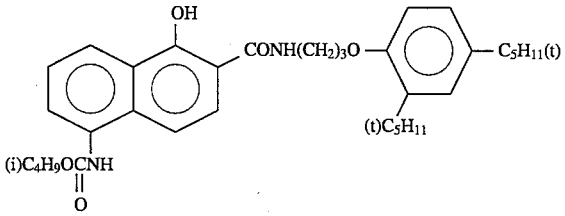
EX-15
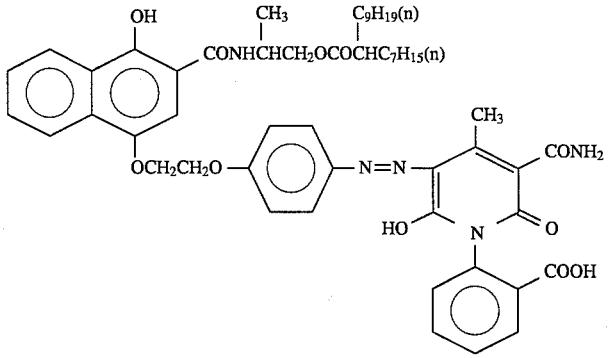

TABLE A-continued
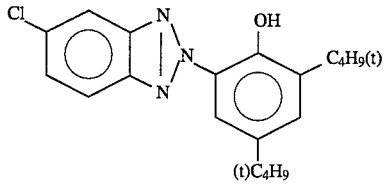
U-1
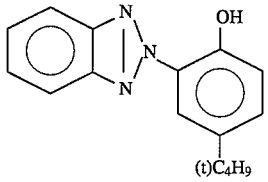
U-2
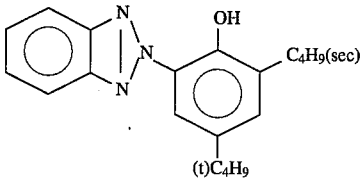
U-3
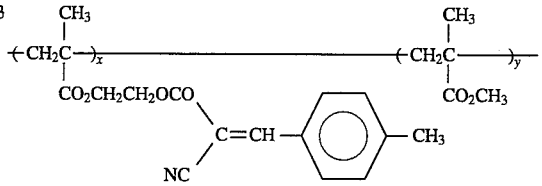
U-4
x:y = 70:30 (wt %)
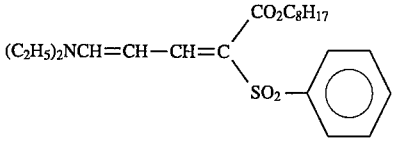
U-5
Tricresylphosflate
HBS-1
Di-n-bulylphthalate
HBS-2
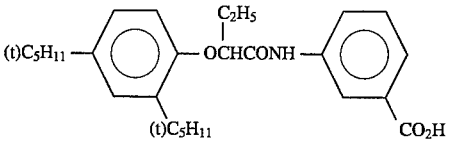
HBS-3
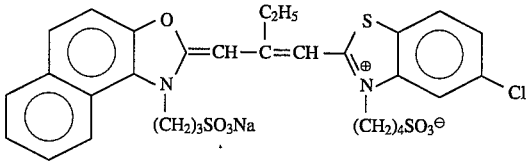
Sensitizing Dye I
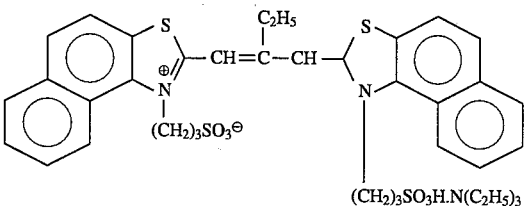
Sensitizing Dye II
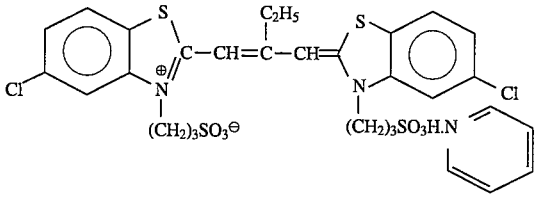
Sensitizing Dye III
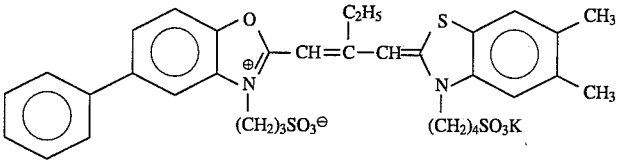
Sensitizing Dye IV
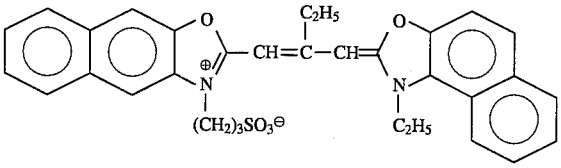
Sensitizing Dye V TABLE A-continued
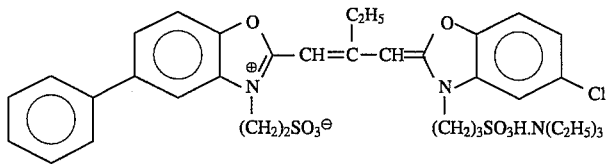
Sensitizing Dye VI
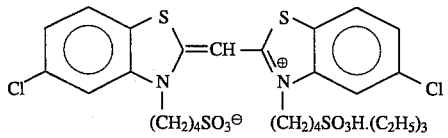
Sensitizing Dye VII
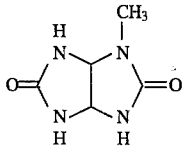
S-1
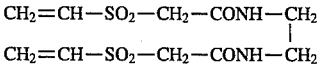
H-1
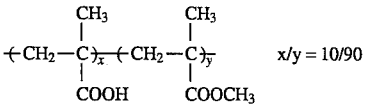
B-1
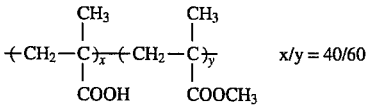
B-2
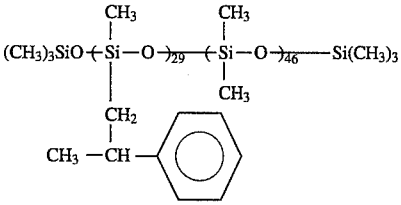
B-3
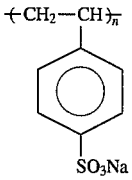
B-4
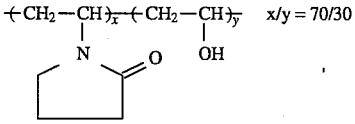
B-5
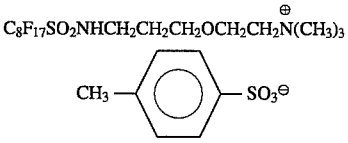
W-1
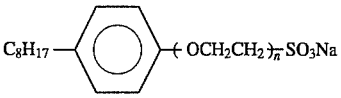
n = 2 to 4
W-2
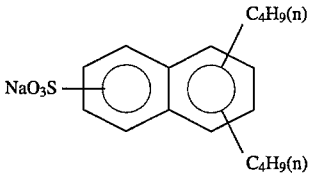
W-3
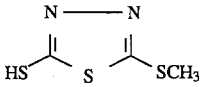
F-1
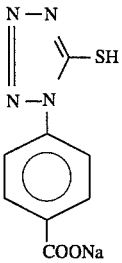
F-2

TABLE A-continued

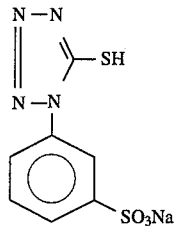

F-3

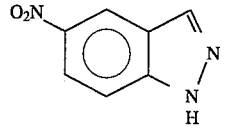

F-4

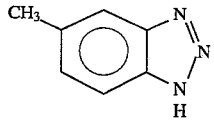

F-5

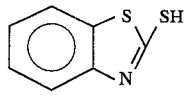

F-6

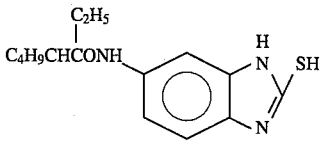

F-7

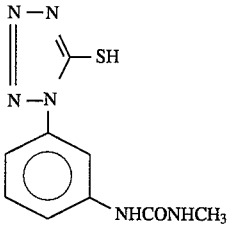

F-8

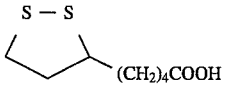

F-9

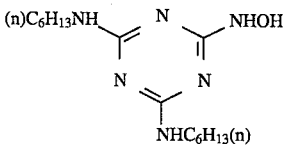

F-10

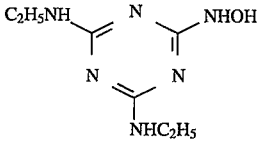

F-11

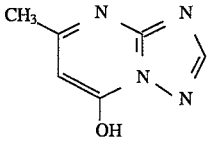

F-12

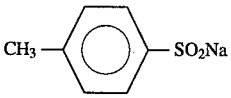

F-13

What is claimed is:

1. A silver halide photographic light-sensitive material comprising a support and at least one silver halide emulsion layer formed on the support, said emulsion layer containing at least one silver halide emulsion which is a tellurium-sensitized monodispersed emulsion, wherein said silver halide emulsion has been tellurium-sensitized in the presence of at least one compound represented by the following formula (I):

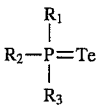

Formula (I)

where $R_1$, $R_2$ and $R_3$ are aliphatic groups, aromatic groups, heterocyclic groups, $OR_4$, $NR_5(R_6)$, $SR_7$, $OSiR_8(R_9)(R_{10})$, X or hydrogen atoms, $R_4$ and $R_7$ are aliphatic groups, aromatic groups, heterocyclic group, hydrogen atoms or cations, $R_5$ and $R_6$ are aliphatic groups, aromatic groups, heterocyclic groups or hydrogen atoms, $R_8$, $R_9$ and $R_{10}$ are aliphatic groups, and X is a halogen atom.

2. The light-sensitive material according to claim 1, wherein said monodispersed silver halide emulsion has a variation coefficient of 22% or less in terms of grain-size distribution.

3. The light-sensitive material according to claim 1, wherein said monodispersed silver halide emulsion has a variation coefficient of 18% or less in terms of grain-size distribution.

4. The light-sensitive material according to claim 1, wherein the compound of formula (I) forms silver telluride at a pseudo-first-order reaction rate constant K of $1\times10^{-7}$ to $1\times10^{-1}$ $min^{-1}$ when reacted with a silver halide emulsion.

5. The light-sensitive material according to claim 1, wherein said monodispersed silver halide emulsion has been subjected to tellurium sensitization and sulfur sensitization.

6. The light-sensitive material according to claim 1, wherein the compound of formula (I) reacts with a silver halide emulsion at a temperature of 40° C. to 95° C., at pH of 3 to 10, and pAg of 6 to 11, to form silver telluride.

7. The light-sensitive material according to claim 1, wherein said silver halide emulsion has been gold-sensitized.

8. The light-sensitive material according to claim 1, wherein said silver halide emulsion has been reacted with thiocyanate.

9. The light-sensitive material according to claim 1, wherein the aliphatic groups represented by $R_1$–$R_{10}$ in formula (I) have 1 to 30 carbon atoms.

10. The light-sensitive material according to claim 1, wherein the aromatic groups represented by $R_1$–$R_7$ in formula (I) have 6 to 30 carbon atoms.

11. The light-sensitive material according to claim 1, wherein the heterocyclic groups represented by $R_1$–$R_7$ in formula (I) are saturated or unsaturated 3- to 10-membered heterocyclic groups, each having at least one atom selected from the group consisting of a nitrogen atom, an oxygen atom and a sulfur atom.

12. The light-sensitive material according to claim 1, wherein the cations represented by $R_4$ and $R_7$ in formula (I) are an alkali metal or ammonium.

13. The light-sensitive material according to claim 1, wherein formula (I) , $R_1$, $R_2$ and $R_3$ are aliphatic groups or aromatic groups.

14. The light-sensitive material according to claim 1, wherein said monodispersed silver halide emulsion has a variation coefficient in the range of 15%–30% in terms of grain-size distribution.

15. A silver halide photographic light-sensitive material comprising a support and at least one silver halide emulsion layer formed on the support, said emulsion layer containing at least one silver halide emulsion which is a tellurium-sensitized monodispersed emulsion, wherein said silver halide emulsion has been chemically tellurium-sensitized in the presence of at least one tellurium sensitizer of such type that silver telluride is formed at a pseudo-first-order reaction rate constant k of $1\times10^{-8}$ to 1 $min^{-1}$, wherein said monodispersed silver halide emulsion has a variation coefficient of 22% or less in terms of grain-size distribution, and said silver halide emulsion has been tellurium-sensitized in the presence of at least one compound represented by the following formula (I):

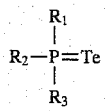

Formula (I)

where $R_1$, $R_2$ and $R_3$ are aliphatic groups, aromatic groups, heterocyclic groups, $OR_4$, $NR_5(R_6)$, $SR_7$, $OSiR_8(R_9)(R_{10})$, X or hydrogen atoms, $R_4$ and $R_7$ are aliphatic groups, aromatic groups, heterocyclic group, hydrogen atoms or cations, $R_5$ and $R_6$ are aliphatic groups, aromatic groups, heterocyclic groups or hydrogen atoms, $R_8$, $R_9$ and $R_{10}$ are aliphatic groups, and X is a halogen atom.

16. A silver halide photographic light-sensitive material comprising a support and at least one silver halide emulsion layer formed on the support, said emulsion layer containing at least one silver halide emulsion which is a tellurium-sensitized monodispersed emulsion, wherein said silver halide emulsion has been chemically tellurium-sensitized in the presence of at least one compound represented by the following formula (IIA):

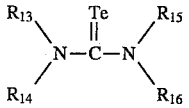

Formula (IIA)

wherein $R_{13}$ and $R_{15}$ combine with each other to form an alkylene group, an arylene group, an aralkylene group or an alkenylene group; and each of $R_{14}$ and $R_{16}$ represents an alkyl group or an aromatic group.

17. The light-sensitive material according to claim 16, wherein the aromatic groups represented by $R_{14}$ and $R_{16}$ have 6 to 30 carbon atoms.

18. The light-sensitive material according to claim 16, wherein said compound is selected from the group consisting of compounds 23, 24, 25 and 26:

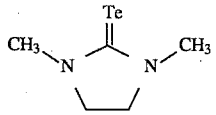

Compound-23

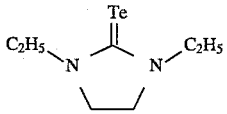

Compound-24

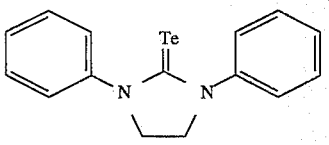

Compound-25 and

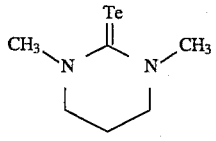

Compound-26

19. A silver halide photographic light-sensitive material comprising a support and at least one silver halide emulsion layer formed on the support, said emulsion layer containing at least one silver halide emulsion which is a tellurium-sensitized monodispersed emulsion, wherein said silver halide emulsion has been chemically tellurium-sensitized in the presence of at least one compound represented by the following formula (IIB):

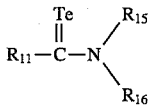

Formula (IIB)

wherein $R_{11}$ and $R_{15}$ combine with each other to form an alkylene group, an arylene group, an aralkylene group or an alkenylene group; and $R_{16}$ represents an alkyl group or an aromatic group.

* * * * *

UNITED STATES PATENT AND TRADEMARK OFFICE

CERTIFICATE OF CORRECTION

PATENT NO. : 5,514,534

DATED : May 7, 1996

INVENTOR(S) : Y. NOZAWA et al.

It is certified that error appears in the above-indentified patent and that said Letters Patent is hereby corrected as shown below:

On the title page: [*] Notice

In the "(*) Notice:" section please change "Pat. No. 5,459,027"

to --Pat. Nos. 5,459,027, 5,215,880, and 5,273,874--.

Signed and Sealed this

Twenty-eighth Day of April, 1998

Bruce Lehman

*Attest:*

BRUCE LEHMAN

*Attesting Officer*

*Commissioner of Patents and Trademarks*